United States Patent [19]

Sakanoue et al.

[11] Patent Number: 4,865,959

[45] Date of Patent: Sep. 12, 1989

[54] SILVER HALIDE COLOR PHOTOGRAPHIC MATERIAL CONTAINING A BLEACH ACCELERATOR RELEASING COMPOUND

[75] Inventors: Kei Sakanoue; Hidetoshi Kobayashi, both of Kanagawa, Japan

[73] Assignee: Fuji Photo Film Co., Ltd., Kanagawa, Japan

[21] Appl. No.: 210,942

[22] Filed: Jun. 24, 1988

[30] Foreign Application Priority Data

Jun. 25, 1987 [JP] Japan ..... 62-156414

[51] Int. Cl.[4] ..... G03C 7/34; G03C 7/26

[52] U.S. Cl. ..... 430/548; 430/393; 430/430; 430/549; 430/552; 430/553; 430/955

[58] Field of Search ..... 430/552, 553, 549, 955, 430/393, 430, 548

[56] References Cited

U.S. PATENT DOCUMENTS

| | | | |
|---|---|---|---|
| 4,333,999 | 6/1982 | Lau | 430/552 |
| 4,427,767 | 1/1984 | Aoki et al. | 430/553 |
| 4,528,263 | 7/1985 | Sugita et al. | 430/553 |
| 4,609,619 | 9/1986 | Katoh et al. | 430/553 |
| 4,772,543 | 9/1988 | Sato et al. | 430/553 |

FOREIGN PATENT DOCUMENTS 193389 9/1986 European Pat. Off. .

OTHER PUBLICATIONS

Research Disclosure No. 11449, Oct. 1973, "Bleach Accelerator Releasing Couplers".

Research Disclosure 24241, Jun. 1984, Pollet et al., "Compounds Capable of releasing a developement-influencing moiety", pp. 286–292.

*Primary Examiner*—Richard L. Schilling

*Attorney, Agent, or Firm*—Sughrue, Mion, Zinn, Macpeak & Seas

[57] ABSTRACT

A silver halide color photographic material having on a support at least one silver halide emulsion layer, wherein the color photographic material contains at least one compound releasing a bleach accelerator upon reaction with the oxidation product of an aromatic primary amine color developing agent and at least one cyan dye-forming coupler represented by formula (A);

(A)

wherein $R_1$ represents a substituted or unsubstituted aliphatic group, a substituted or unsubstituted aromatic group; or a substituted or unsubstituted heterocyclic group; X represents a hydrogen atom or a group capable of releasing upon a coupling reaction with the oxidation product of an aromatic primary amine color developing agent; and Ar represents an aromatic group having at least one substituent, wherein the sum of the $\sigma_m$ and $\sigma_p$ values of the substituent is at least 0.67.

17 Claims, No Drawings

SILVER HALIDE COLOR PHOTOGRAPHIC MATERIAL CONTAINING A BLEACH ACCELERATOR RELEASING COMPOUND

FIELD OF THE INVENTION

This invention relates to a silver halide color photographic material, and in particular, to a silver halide color photographic material containing a bleach accelerator releasing compound.

BACKGROUND OF THE INVENTION

In general, a silver halide color photographic material is fundamentally processed by a color developing step and a desilvering step after imagewise exposure to light. In the color developing step, the exposed silver halide in the color photographic material is reduced to form silver and at the same time the oxidized color developing agent in the color developer reacts with color formers (couplers) in the color photographic material to form dye images. Silver formed in this manner is oxidized by a bleaching agent in the subsequent desilvering step, further converted into a soluble silver complex by the action of a fixing agent, and dissolved off Recently in this field, quickening of processing, that is, shortening of the time required for photographic processing has been strongly desired and shortening of the desilvering step (which usually takes up about half of the overall processing time) has become an attractive area to researchers.

As a method of increasing the bleaching power, there are certain descriptions of bleach accelerating compound releasing couplers in *Research Disclosure,* No. 4241, ibid., No. 11449, and Japanese Patent Application (OPI) No. 201247/86 (the term "OPI" as used herein indicates an "unexamined published Japanese patent application") and it is known that by using a silver halide photographic material containing such as a bleach accelerating compound releasing coupler, the desilvering property thereof is improved.

However, it has now been found that when a color photographic light-sensitive material containing the bleach accelerating compound releasing coupler is quickly processed in the desilvering step thereof, the recoloring property of cyan images is greatly deteriorated.

On the other hand, various cyan image-forming couplers, which are effective for improving the recoloring property of cyan images, are known (such as, for example, phenolic cyan couplers having a ureido group at the 2-position described in U.S. Pat. No. 4,333,999, Japanese Patent Application (OPI) Nos. 207593/82, 204544/82, and 2011863/83, naphtholic cyan couplers having an amido group at the 5-position described in Japanese Patent Application (OPI) Nos. 237448/85, 145557/86, and 153640/86, and 2,5-diacylaminophenol type cyan couplers, etc., in the field of color photographic papers) and also, in aforesaid Japanese Patent Application (OPI) No. 201247/86 relating to bleach accelerating compound releasing couplers, a 2-ureidophenolic cyan coupler having a 4-cyanophenyl group, which is one type of cyan image-forming couplers somewhat effective at improving the recoloring property, is used in an example.

However, it has also been found that since such 2-ureidophenol type cyan coupler having a 4-cyanophenyl group has a tendency to shift the absorption wavelength thereof to the longer wavelength side by the association of molecules when the concentration thereof is increased. Thus, the color photographic material using the cyan coupler changes its maximum absorption wavelength due to this difference in color density, whereby color images having satisfactory color balance are not obtained.

SUMMARY OF THE INVENTION

The present invention solves the aforesaid problem in a silver halide color photographic material containing a bleach accelerator releasing compound.

One object of this invention is, therefore, to provide a silver halide color photographic material which is excellent in the speed of desilvering and shows an improved recoloring property and color balance.

It has now been discovered that the aforesaid and other objects and advantages of this invention are attained by a silver halide color photographic material as set forth hereinbelow.

That is, according to this invention, there is provided a silver halide color photographic material having on a support at least one silver halide emulsion layer, said color photographic material containing at least one compound releasing a bleach accelerator upon reaction with the oxidation product of an aromatic primary amine color developing agent (hereinafter, this compound is referred to as a bleach accelerator releasing compound) and at least one cyan dye-forming coupler represented by formula (A);

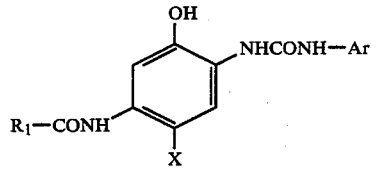

(A)

wherein $R_1$ represents a substituted or unsubstituted aliphatic group, a substituted or unsubstituted aromatic group, or a substituted or unsubstituted heterocyclic group; X represents a hydrogen atom or a group releasable upon a coupling reaction with the oxidation product of an aromatic primary amine color developing agent; and Ar represents an aromatic group having at least one substituent, wherein the sum of the $\sigma_m$ and $\sigma_p$ values of the substituent is at least 0.67.

DETAILED DESCRIPTION OF THE INVENTION

It has been astonishingly found that when the cyan dye-forming coupler shown by formula (A) described above, wherein the sum of the $\sigma_m$ and $\sigma_p$ values of the substituent(s) bonded to the aromatic group shown by Ar is at least 0.67, is used together with a bleach accelerator releasing compound (as described hereinafter) in a silver halide color photographic material, the recoloring property thereof is surprisingly improved and the color balance of the color images obtained is also surprisingly improved. This is considered to be due to the fact that the cyan dye-forming coupler (wherein the sum of $\sigma_m$ and $\sigma_p$ values, calculated according to Hammett's rule, of the substituent(s) of the aromatic group is at least 0.67) has less tendency to shift to a long wavelength side of the maximum absorption wavelength by the association of the molecules upon an increase of their concentration.

Furthermore, it has also been astonishingly found that when the above cyan dye-forming coupler is used, the storage stability of the color photographic material is improved in, particularly, the latent image regression.

The bleach accelerator releasing compounds for use in this invention are preferably the compounds shown by formula (I) described below:

$$A-(L)_p-Z \quad (I)$$

wherein A represents a group releasing from $(L)_p$—Z upon reaction with the oxidation product of a color developing agent; L represents a timing group or a group releasing from Z upon reaction with the oxidation product of a color developing agent; p represents an integer of from 0 to 3; when p is plural, said Ls may be the same or different; and Z represents a group having a bleach acceleration effect when the A-$(L)_p$ bond is cleaved.

Furthermore, the compounds shown by the following formulae (II) to (VI) are preferably used as the bleach accelerator releasing compounds:

$$A-(L_1)_a-S-\underbrace{R_{31}-X_1-R_{32}}_{(Z)_b} \quad (II)$$

$$A-(L_1)_a-S-\underbrace{(R_{31}-X_2)_l-R_{32}}_{(Z)_b} \quad (III)$$

$$A-(L_1)_a-S-\underbrace{\{R_{31}-(X_2)_m\}_r-R_{33}}_{(Z)_u} \quad (IV)$$

$$A-(L_1)_a-S-R_{31}-(Z)_t \quad (V)$$

$$A-L_2-S-\underbrace{\{R_{31}-(X_2)_m\}_r-R_{34}}_{(Z)_b} \quad (VI)$$

wherein

A represents a coupler residue or an oxidationreduction group;

$L_1$ represents a timing group;

$L_2$ represents a group becoming a coupler residue after cleaving from A or a group becoming an oxidationreduction group after cleaving from A;

$R_{31}$ and $R_{32}$, which may be the same or different, each represents a substituted or unsubstituted aliphatic group having from 1 to 6 carbon atoms or a substituted or unsubstituted aromatic group having from 6 to 10 carbon atoms;

$R_{33}$ represents a 3- to 7-membered carbon ring group or a 3- to 7-membered substituted or unsubstituted heterocyclic ring having less then 4 nitrogen atoms as the ring-constituting atoms;

$R_{34}$ is the same as defined above for $R_{31}$ or represents a 3- to 7-membered substituted or unsubstituted heterocyclic group;

$X_1$ represents —S—, —COO—, $$-\underset{\underset{R_{35}}{|}}{N}CO-,\ -\underset{\underset{R_{35}}{|}}{N}SO_2-,\ -\underset{\underset{R_{35}}{|}}{N}-,$$

—CO—, $-SO_2-$, or $-SO_2O-$;

$X_2$ is the same as defined above for $X_1$ or —O—;

Z represents a carboxy group, a sulfo group, a hydroxy group or $$-N\begin{matrix}R_{35}\\R_{36}\end{matrix};$$

$R_{35}$ and $R_{36}$, which may be the same or different, each represents a hydrogen atom or a substituted or unsubstituted aliphatic group having from 1 to 3 carbon atoms;

a represents 0 or 1;

b represents an integer of from 1 to 3, and when b is plural, said Zs may be the same or different;

l represents 2 or 3 and said $l(R_{31}-X_2)$s may be the same or different;

m represents 0 or 1;

r represents an integer of from 0 to 3, and when r is plural, said plural $\{R_{31}-(X_2)_m\}$s may be the same or different;

u represents an ,integer of from 0 to 3; when $R_{33}$ is a carbon ring said u is, however, 1 to 3, and when u is plural said Zs of $(Z)_u$ may be the same or different; and t represents 2 or 3 and said plural Zs of $(Z)_t$ may be the same of different.

In formulae (I) to (VI) described above, A represents a group releasing from $(L)_p$-Z upon reaction with the oxidation product of a color developing agent, preferably, a coupler residue or an oxidation-reduction group.

Examples of the coupler residue shown by A are yellow coupler residues (e.g., an open chain ketomethylene type coupler residue), magenta coupler residues (e.g., a 5-pyrazolone type coupler residue, a pyrazoloimidazole type coupler residue, and a pyrazolotriazole type coupler residue), cyan coupler residues (e.g., a phenolic coupler residue and naphtholic coupler residue), and non-coloring coupler residues (e.g., an indanone type coupler residue and an acetophenone type coupler residue). Also, the heterocyclic coupler residues described in U.S. Pat. Nos. 4,315,070, 4,183,752, 3,961,959, and 4,171,223 may be also used as the coupler residue.

When A in formulae (I) to (VI) represents a coupler residue, preferred examples of the coupler residue are those shown by the following formulae (Cp-1), (Cp-2), (Cp-3), (Cp-4), (Cp-5), (Cp-6), (Cp-7), (Cp8), (Cp-9) or (Cp-10). These couplers show high coupling speed and are preferably used in this invention.

$$R_{51}\underset{\underset{|}{}}{C}(=O)CH(R_{52})CNH-R_{52} \quad (Cp\text{-}1)$$

$$R_{52}NHC(=O)CH(R_{52})C(=O)NHR_{53} \quad (Cp\text{-}2)$$

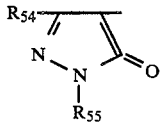

(Cp-3)

-continued (Cp-4)

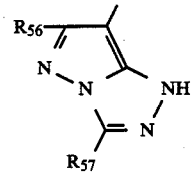

(Cp-5)

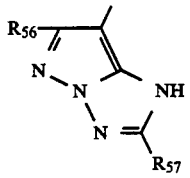

(Cp-6)

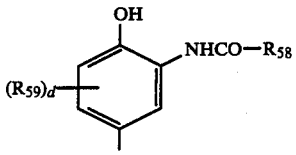

(Cp-7)

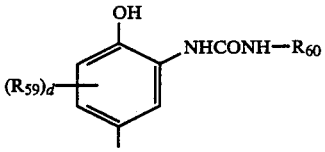

(Cp-8)

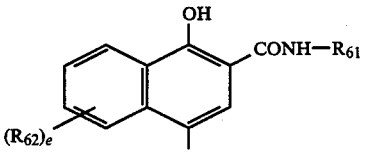

(Cp-9)

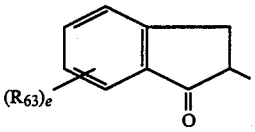

(Cp-10)

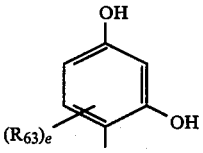

In each of the aforesaid formulae, the free bond at the coupling position is the bonding position of the coupler residue to $(L)_p$—Z. In the above formulae, when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ includes a non-diffusible group, the group is selected so that the total number of carbon atoms is from 8 to 40, and preferably from 10 to 30, and when these substituents do not include a non-diffusible group, the total carbon atom number of the group is preferably less than 15.

In the case of bis type, telomer type, or polymer type couplers, any one of these substituents represents a divalent group bonding recurring units thereto. In this case, the carbon atom number range may be outside the above-defined range.

$R_{51}$ to $R_{63}$, d and e are explained in detail below.

In the following formulae, R4l represents substituted or unsubstituted aliphatic group, a substituted or unsubstituted aromatic group, or a substituted or unsubstituted heterocyclic group; R42 represents a substituted or unsubstituted aromatic group or a substituted or unsubstituted heterocyclic group; and $R_{43}$, $R_{44}$, and $R_{45}$ each represents a hydrogen atom, a substituted or unsubstituted aliphatic group, a substituted or unsubstituted aromatic group, or a substituted or unsubstituted heterocyclic group.

$R_{51}$ has the same meaning as $R_{41}$. $R_{52}$ and $R_{53}$ each has the same meaning as $R_{42}$. $R_{54}$ has the same meaning as $R_{41}$, or represents $$R_{41}CON(R_{43})-,\ R_{41}N(R_{43})-,\ R_{41}SO_2N(R_{43})-,\ R_{41}S-,\ R_{43}O-,\ R_{45}NCON(R_{43})(R_{44})-,$$

$$R_{41}OCC-,\ R_{41}NCO(R_{43})-,\ \text{or}\ N\equiv C-.$$

$R_{55}$ has the same meaning $R_{41}$. $R_{56}$ and $R_{57}$ each has the same meaning as $R_{41}$ or represents $R_{41}S$—, $R_{41}O$—

$$R_{41}CON(R_{43})-,\ R_{41}N(R_{43})-,\ R_{43}NCON(R_{44})(R_{45})-,\ \text{or}\ R_{41}SON(R_{43})-.$$

$R_{58}$ has the same meaning as $R_{41}$.

$R_{59}$ has the same meaning as $R_{41}$ or represents $$R_{41}CON(R_{43})-,\ R_{41}OCON(R_{43})-,\ R_{41}SO_2N(R_{43})-,\ R_{43}NCON(R_{44})(R_{45})-,$$

$$R_{43}NSO_2N(R_{44})(R_{45})-,$$

$R_{41}O$—, $R_{41}S$—, a halogen atom or $$R_{41}N(R_{43})-.$$

Also, d represents an integer of 0 to 3. When d is plural, said $R_{59}$s may be the same or different. In this case, each $R_{59}$ may combine with each other as divalent group to form a cyclic structure. Examples of the divalent group for forming the aforesaid cyclic structure are

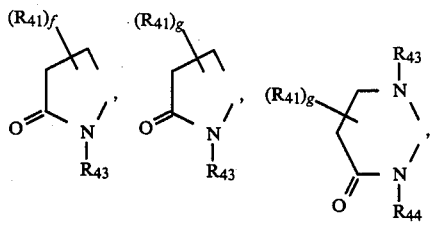

etc., wherein f is an integer of from 0 to 4 and g is an integer of from 0 to 2.

$R_{60}$ has the same meaning as $R_{41}$ and $R_{61}$ also has the same meaning as $R_{41}$.

$R_{62}$ has the same meaning as $R_{41}$ or represents $R_{41}CONH$—, $R_{41}OCONH$—, $R_{41}SO_2NH$—, $R_{43}\underset{\underset{R_{44}}{|}}{N}C\underset{\underset{R_{45}}{|}}{O}N-$, $R_{43}\underset{\underset{R_{44}}{|}}{N}SO_2N-$, $R_{43}O-$, $R_{41}S-$, a halogen atom or $R_{41}\underset{\underset{R_{43}}{|}}{N}-$.

$R_{63}$ has the same meaning as $R_{41}$ or represents $R_{43}\underset{\underset{R_{44}}{|}}{C}O\underset{\underset{R_{45}}{\backslash}}{N}-$, $R_{43}\underset{\underset{R_{44}}{|}}{N}CO-$, $R_{41}SO_2\underset{\underset{R_{44}}{|}}{N}-$, $R_{43}\underset{\underset{R_{44}}{|}}{N}SO_2-$, $R_{41}SO_2-$, $R_{43}OCO-$, $R_{43}OSO_2-$, a halogen atom, a nitro group, a cyano group, $R_{43}CO-$, $R_{41}CONH-$, $R_{41}SO_2NH-$, or $R_{41}-\underset{\underset{R_{43}}{|}}{N}CO-$.

In the above formulae, e represents an integer of from 0 to 4 and when e is plural, said $R_{62}$s OR $R_{63}$s may be the same or different.

In the aforesaid formulae (Cp-1) to (Cp-10), the aliphatic group is a saturated or unsaturated, cyclic, straight or branched chain, substituted or unsubstituted aliphatic group having from 1 to 32 carbon atoms, and preferably from 1 to 22 carbon atoms. Typical examples of the aliphatic group are a methyl group, an ethyl group, a propyl group, an isopropyl group, a butyl group, a t-butyl group, an i-butyl group, a t-amyl group, a hexyl group, a cyclohexyl group, a 2-ethylhexyl group, an octyl group, a 1,1,3,3-tetramethylbutyl group, a decyl group, a dodecyl group, a hexadecyl group, or an octadecyl group.

The aromatic group is a substituted or unsubstituted phenyl group having 6 to 20 carbon atoms or a substituted or unsubstituted naphthyl group.

The heterocyclic group is preferably 3- to 8membered substituted or unsubstituted heterocyclic group having from 1 to 20, and preferably from 1 to 7 carbon atoms and having a nitrogen atom, an oxygen atom or a sulfur atom as the hetero atom or atoms. Typical examples of the heterocyclic groups are a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-l,3-imidazolidin-5-yl group, a 2,4-dioxo-1,3-imidazolidin-3-yl group, a succinimido group, a phthalimido group, a 1,2,4-triazol-2-yl group, and a 1-pyrazolyl group.

When the aforesaid aliphatic group, aromatic group, or heterocyclic group has a substituent, typical examples of the substituent are halogen atom, $R_{47}O-$, $R_{46}S-$, $R_{47}\underset{\underset{R_{48}}{|}}{N}CO-$, $R_{47}\underset{\underset{R_{48}}{|}}{N}CO-$, $R_{46}O\underset{\underset{R_{47}}{|}}{N}CO-$, $R_{46}SO_2\underset{\underset{R_{47}}{|}}{N}-$, $R_{47}\underset{\underset{R_{48}}{|}}{N}SO_2-$, -continued $R_{46}SO_2-$, $R_{47}OCO-$, $R_{47}\underset{\underset{R_{48}}{|}}{N}C\underset{\underset{R_{49}}{|}}{O}N-$, defined for $R_{46}$,

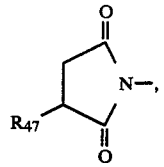

$R_{46}COO-$, $R_{47}OSO_2-$, a cyano group, and a nitro group. $R_{46}$ represents an aliphatic group, an aromatic group or a heterocyclic group; $R_{47}$, $R_{48}$ and $R_{49}$ each represents an aliphatic group, an aromatic group, a heterocyclic group or a hydrogen atom. The aliphatic group, aromatic group, and heterocyclic group have the same meaning as defined above in formulae (Cp-1) to (Cp-10).

Preferred groups of $R_{51}$ to $R_{63}$, d and e are explained below.

$R_{51}$ is preferably an aliphatic group or an aromatic group.

$R_{52}$, $R_{53}$ and $R_{55}$ are preferably an aromatic groups.

$R_{54}$ is preferably $R_{41}CONH-$ or $R_{41}-\underset{\underset{R_{43}}{|}}{N}-$.

$R_{56}$ and $R_{57}$ are preferably an aliphatic group, $R_{41}O-$ or $R_{41}S-$.

$R_{58}$ is preferably an aliphatic group or an aromatic group.

In formula (Cp-6), $R_{59}$ is preferably a chlorine atom, an aliphatic group or $R_{41}CONH-$, d is preferably 1 or 2, and $R_{60}$ is preferably an aromatic group.

In formula (Cp-7), $R_{59}$ is preferably $R_{41}CONH-$, d is preferably 1. $R_{61}$ is preferably an aliphatic group or an aromatic group.

In formula (Cp-8), e is preferably 0 or 1 and $R_{62}$ is preferably $R_{41}OCONH-$, $R_{41}CONH-$, or $R_{41}SO_2NH-$, $R_{62}$ being preferably located at the 5-position of the naphthol ring.

In formula (Cp-9), $R_{63}$ is preferably $R_{41}CONH-$, $R_{41}SO_2NH-$, $R_{41}\underset{\underset{R_{43}}{|}}{N}SO_2$, $R_{41}SO_2-$, $R_{41}\underset{\underset{R_{43}}{|}}{N}CO-$, a nitro group or a cyano group.

In formula (Cp-10), $R_{63}$ is preferably $R_{43}\underset{\underset{R_{43}}{|}}{N}CO-$, $R_{43}OCO-$, or $R_{43}CO-$.

Typical specific examples of $R_{51}$ to $R_{63}$ are set forth below.

Examples of R5l are a t-butyl group, a -methoxyphenyl group, a phenyl group, a 3-{2-(2,4-di-t-amylphenoxy)butanamido.}phenyl group, a 4-octadecyloxyphenyl group, and a methyl group.

Examples of $R_{52}$ and $R_{53}$ are a 2-chloro-5-dodecyloxycarbonylphenyl group, a 2-chloro-5-hexadecylsulfonamidophenyl group, a 2-chloro-5-tetradecanamidophenyl group, a 2-chloro-5-{4-(2,4-di-t-amylphenoxy)butanamido}phenyl group, a 2-chloro-5-{2-(2,4-di-t-amylphenoxy)butanamido}phenyl group, a 2-methoxyphenyl group, a 2-methoxy-5-tetradecyloxycarbonylphenyl group, a 2-chloro-5-(l-ethoxycarbonylethoxycarbonyl)phenyl group, a 2-pyridyl group, 2-chloro-5-octylcarbonylphenyl group, a 2,4-dichlorophenyl group, a 2-chloro-5-(1-dodecyloxycarbonylethoxycarbonyl)phenyl group, a 2-chlorophenyl group, and a 2-ethoxyphenyl group.

Examples of $R_{54}$ are a 3-{2-(2,4-di-t-amylphenoxy)butanamido}benzamido group, a 3-{4-(2,4-di-t-amylphenoxy)butanamido}benzamido group, a 2-chloro-5-tetradecanamidoanilino group, a 5-(2,4-di-t-amylphenoxyacetamido)benzamido group, a 2-chloro-5-dodecenylsuccinimidoanilino group, a 2-chloro-5-{2-(3-t-butyl-4-hydroxyphenoxy)tetradecanamido}anilino group, a 2,2-dimethylpropanimido group, a 2-(3-pentadecylphenoxy)butanamido group, a pyrrolidino group, and a N,N-dibutylamino group.

Examples of $R_{55}$ are a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-t-amylphenoxy)butanamido} phenyl group, and a 2,6-dichloro-4-methanesulfonylphenyl group.

Examples of $R_{56}$ are a methyl group, an ethyl group, an isopropyl group, a methoxy group, an ethoxy group, a methylthio group, an ethylthio group, a 3-phenylureido group, a 3-butylureido group and a 3-(2,4-di-t-amylphenoxy)propyl group.

Examples of $R_{57}$ are a 3-(2,4-di-t-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a methyl group, a 1-methyl-2-{2-octyloxy-5-[2-octyloxy-5-(1,1,3,3-tetramethylbutyl)phenylsulfonamido]phenylsulfonamido}ethyl group, a 3-{4-(4-dodecyloxyphenylsulfonamido)phenyl}propyl group, a 1,1-dimethyl-2-{2-octyloxy-5-(l,l,3,3-tetramethylbutyl)phenylsulfonamido}ethyl group, and a dodecylthio group.

Examples of $R_{58}$ are a 2-chlorophenyl group, a pentafluorophenyl group, a pentafluoropropyl group, a 1-(2,4-di-t-amylphenoxy)propyl group, a 3-(2,4-di-t-amylphenoxy)propyl group, a 2,4-di-t-amylmethyl group, and a furyl group.

Examples of $R_{59}$ are a chlorine atom, a methyl group, an ethyl group, a propyl group, a butyl group, an isopropyl group, a 2-(2,4-di-t-amylphenoxy)butanamido group, a 2-(2,4-di-t-amylphenoxy)hexanamido group, a 2-(2,4-di-t-octylphenoxy)octanamido group, a 2-(2-chlorophenoxy)tetradecanamido group, a 2,2-dimethylpropanamido group, a 2-{4-(4-hydroxyphenylsulfonyl)phenoxy}tetradecanamido group, and a 2-}2-(2,4-di-t-amylphenoxyacetamido)phenoxy}butanamido group.

Examples of $R_{60}$ are a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, and a 3-methoxycarbonylphenyl group.

Examples of $R_{61}$ are a dodecyl group, a hexadecyl group, a cyclohexyl group, a butyl group, a 3-(2,4-di-t-amylphenoxy)propyl group, a 4-(2,4-di-t-amylphenoxy)butyl group, a 3-dodecyloxypropyl group, a 2-tetradecyloxyphenyl group, a t-butyl group, a 2-(2-hexyldecyloxy)phenyl group, a 2-methoxy-5-dodecyloxycarbonylphenyl group, a 2-butoxyphenyl group, and a 1-naphthyl group.

Examples of $R_{62}$ are an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, trifluoroacetamido group, a 3-phenylureido group, a butoxycarbonylamino group, and an acetamido group.

Examples of $R_{63}$ are a 2,4-di-t-amylphenoxyacetamido group, a 2-(2,4-di-t-amylphenoxy)butanamido group, a hexadecylsulfonamido group, an N-methyl-N-octadecylsulfamoyl group, an N,N-dioctylsulfamoyl group, a 4-t-octylbenzoyl group, a dodecyloxycarbonyl group, a chlorine atom, a fluorine atom, a nitro group, a cyano group, an N-{4-(2,4-di-t-amylphenoxy)butyl}carbamoyl group, an N-3-(2,4-di-t-amylphenoxy)propylsulfamoyl group, a methanesulfonyl group, and a hexadecylsulfonyl group.

Whan A in formulae (I) to (VI) is an oxidation-reduction group, A is more specifically described by the following formula (VII):

$$A_1—P—(X=Y)_n—Q—A_2 \qquad \text{(VII)}$$

wherein P and Q each independently represents an oxygen atom or a substituted or unsubstituted imino group; at least one of X and Y represents a methine group bonding to the moiety of formulae (I) to (VI), exclusive of A, as a substituent and the other of X and Y represents a substituted or unsubstituted methine groups or nitrogen atoms; n represents an integer of from 1 to 3 (when n is plural, nXs or nYs may be the same or different); and $A_1$ and $A_2$, which may be the same or different, each represents a hydrogen atom or a group capable of being removed upon reaction with an alkaline substance.

The compound of the aforesaid formula (VII) includes a case such that two of said P, X, Y, Q, $A_1$ and $A_2$ combine with each other as divalent groups to form a cyclic structure. For example, the compound includes a case such that $(X=Y)_n$ forms a benzene ring or a pyridine ring.

When P and Q represent a substituted or unsubstituted imino group, P and Q are preferably an imino group substituted by a sulfonyl group or an acyl group.

In this case, P and Q are represented by the following formula (N-1) or (N-2);

$$\begin{array}{l} *—N—** \\ \quad\ \ | \\ \quad SO_2—G \end{array} \qquad \text{(N-1)}$$

$$\begin{array}{l} *—N—** \\ \quad\ \ | \\ \quad CO—G \end{array} \qquad \text{(N-2)}$$

wherein * represents a position of bonding to $A_1$ or $A_2$ and ** represents a position of bonding to one of the free bonds of $—(X=Y)_n—$.

In formulae (N-1) and (N-2) described above, G represents a straight chain, branched chain, or cyclic saturated or unsaturated, substituted or unsubstituted aliphatic group having from 1 to 32, and preferably from 1 to 22 carbon atoms (e.g., a methyl group, an ethyl group, a benzyl group, a phenoxybutyl group, and an isopropyl group), a substituted or unsubstituted aromatic group having from 6 to 10 carbon atoms (e.g., a phenyl group, a 4-methylphenyl group, a 1-naphthyl group, and a 4-dodecyloxyphenyl group), or a 4- to 7-membered heterocyclic group having a nitrogen atom, a sulfur atom, or an oxygen atom as the hetero atom or atoms (e.g., a 2-pyridyl group, a 1-phenyl-4-imidazolyl group, a 2-furyl group, and a benzothienyl, group).

In formula (VII) described above, P and Q are preferably independently an oxygen atom or a group defined by formula (N-1) described above.

When $A_1$ and $A_2$ represent a group capable of being removed upon reaction with an alkaline substance (hereinafter, the group is referred to as a precursor group), $A_1$ and $A_2$ are preferably a group capable of being hydrolyzed (e.g., an acyl group, an alkoxycarbonyl group, an aryloxycarbonyl group, a carbamoyl group, an imidoyl group, an oxazolyl group, and a sulfonyl group), a precursor group of the type of utilizing a reverse Michael reaction described in U.S. Pat. No. 4,009,029, a precursor group of the type utilizing an anion formed after the ring cleavage reaction as an intramolecular nucleophilic group described in U.S. Pat. No. 4,310,612, a precursor group wherein an anion causes an electrontransfer through a conjugated system to cause, thereby, a cleavage reaction described in U.S. Pat. Nos. 3,674,478, 3,932,480, and 3,993,661, a precursor group causing a cleavage reaction by an electron-transfer of an anion reacted after ring cleavage described in U.S. Pat. No. 4,335,200 or a precursor group of the type utilizing an imidomethyl group described in U.S. Pat. Nos. 4,363,865 and 4,410,618.

In formula (VII) described above, it is preferred that P represents an oxygen atom and $A_2$ represents a hydrogen atom.

In formula (VII), it is more preferred that other X and Y groups than the embodiments wherein X and Y are a methine group bonding to the moiety of formula (I) to (V), exclusive of A, are a substituted or unsubstituted methine group.

A particularly preferred group among the groups represented by formula (VII) described above is represented by the following formulae (VIII) or (IX);

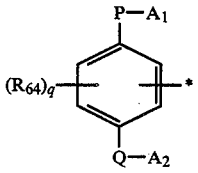
(VIII)

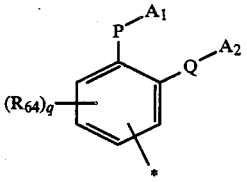
(IX)

wherein * represents a position of bonding to the moiety shown by formula (I) to (VI) exclusive of A; P, Q, $A_1$ and $A_2$ have the same meaning as defined above in formula (VII); $R_{64}$ represents a substituent; and q represents an integer of from 0 to 3. When q is 2 or 3, $R_{64}$s may be the same or different.

When two $R_{64}$s are substituents on adjacent carbon atoms, the group shown by the aforesaid formulae (VIII and IX) includes a case such that the $R_{64}$s combine with each other as divalent groups to form a cyclic structure In this case, said $R_{64}$s may form a benzene condensed ring such as naphthalenes, benzonorbonenes, chromans, indoles, benzothiophenes, quinolines, benzofurans, 2,3-dihydrobenzofurans, indenes, etc., and they may further have at least one substituent. Preferred examples of the substituent when the aforesaid condensed ring has the substituent and preferred examples of $R_{64}$ when $R_{64}$ does not form a condensed ring are as follows. That is, they are $R_{41}$ (defined above), a halogen atom, $R_{43}O$—, $R_{43}S$—,

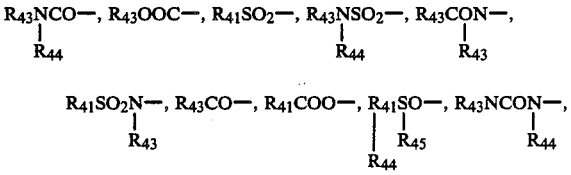

a cyano group, $R_{41}OCON$—, $R_{43}OSO$—,

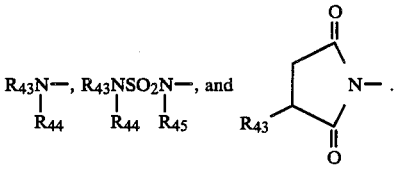

In the above formulae, $R_{41}$, $R_{43}$, $R_{44}$, and $R_{45}$ have the same meaning as defined above.

In formulae (VIII) and (IX) described above, typical examples of $R_{64}$ are a methyl group, an ethyl group, a t-butyl group, a methoxy group, a methylthio group, a dodecylthio group, a 3-(2,4-di-t-amylphenoxy)propylthio group, an N-3-(2,4,di-t-amylphenoxy)propylcarbamoyl group, an N-methyl-N-octadecylcarbamoyl group, a methoxycarbonyl group, a dodecyloxycarbonyl group, a propylcarbamoyl group, a hydroxy group, and an N,N-dioctylcarbamoyl group.

An example of the cyclic structure formed by two $R_{64}$s is the group shown by the formula

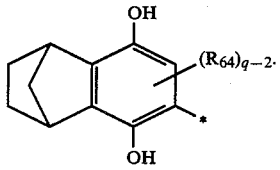

In formulae (VIII) and (IX) described above, P and Q are preferably an oxygen atom.

In formulae (VIII) and (IX), $A_1$ and $A_2$ are preferably a hydrogen atom.

In formulae (II) to (V) described above, Ll may or may not be used in this invention. Preferably, groups containing $L_1$ are not used, but may be suitably selected for certain purposes.

As the timing group shown by $L_1$, there are following known linkage groups:

(1) A group utilizing the cleavage reaction of hemiacetal:

For example, these groups are described in U.S. Pat. No. 4,146,396 and Japanese Patent Application (OPI) Nos. 249148/85 and 249149/85 and are represented by the following formula (T-1):

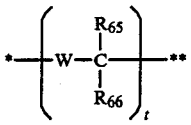

(T-1)

wherein * represents a position of bonding to the left side moiety in formulae (II) to (V) and ** represents a position of bonding to the right side moiety in formulae (II) to (V).

In formulae (T-1), W represents an oxygen atom, a sulfur atom or

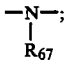

$R_{65}$ and $R_{66}$ represent a hydrogen atom or a substituent; $R_{67}$ represents a substituent; and t represents 1 or 2. When t is 2, the two moietyes represented by

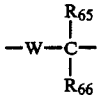

may be the same of different.

when $R_{65}$ and $R_{66}$ represent a substituent, examples of the substituent shown by $R_{65}$ and $R_{66}$ and examples of the substituent shown by $R_{67}$ are the group shown by $R_{69}$, $R_{69}CO$-, $R_{69}SO2$-,

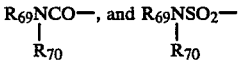

(wherein $R_{69}$ has the same meaning as defined above for $R_{41}$ and $R_{70}$ has the same meaning as defined above for $R_{43}$).

The group shown by formula (T-1) includes a case such that $R_{65}$, $R_{66}$ and $R_{67}$ each combine with each other as a divalent group to form a cyclic structure.

Specific examples of the groups represented by formula (T-1) are as follows:

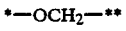

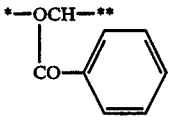

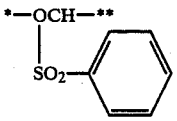

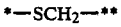

-continued

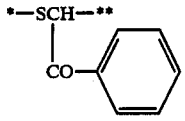

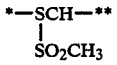

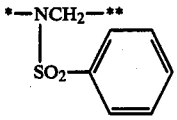

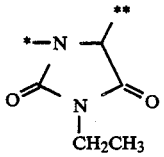

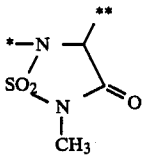

(2) A group causing a cleavage reaction by utilizing an intramolecular nucleophilic reaction:

Examples of this group are the timing groups described in U.S. Pat. No. 4,248,962. This group can be represented by formula (T-2):

*—Nu—Link—E—** (T-2)

wherein * represents a position of bonding to the left side moiety in formulae (II) to (V) described above and  represents a position bonding to the right side moiety in formula (II) to (V); Nu represents a nucleophilic group such as an oxygen atom and a sulfur atom; E represents an electrophilic group which can cleave the bond with  upon nucleophilic attack from Nu; and Link represents a linkage group sterically connecting Nu and E so that Nu and E can cause an intramolecular nucleophilic displacement reaction.

Specific examples of groups represented by formula (T-2) described above are as follows:

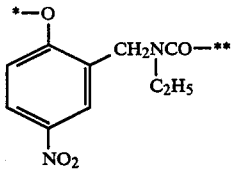

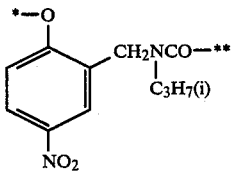

-continued

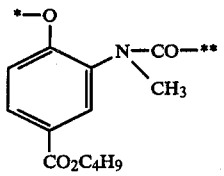

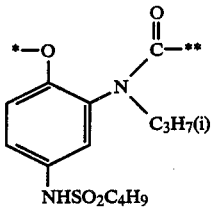

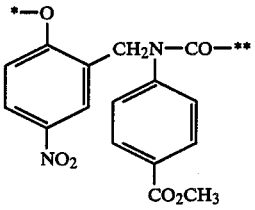

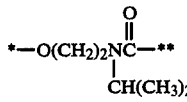

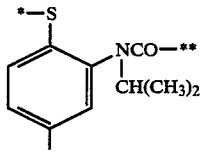

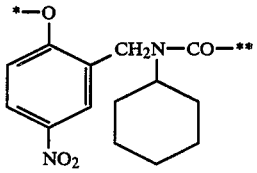

(3) A group causing a cleavage reaction by utilizing an electron-transfer reaction along a conjugated system:

Example of this group are described in U.S. Pat. Nos. 4,409,323 and 4,421,845, and may be represented by formula (T-3):

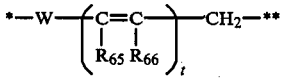

(T-3)

wherein *, **, W, $R_{65}$, $R_{66}$, and to have the same meaning as defined above in formula (T-1).

Specific examples of groups represented by formula (T-3) are as follows:

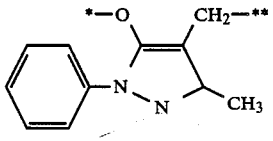

-continued

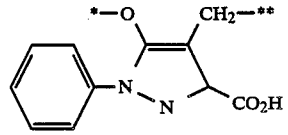

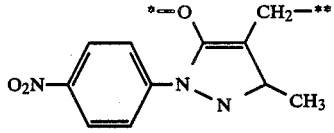

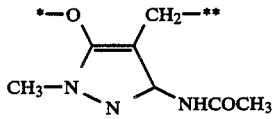

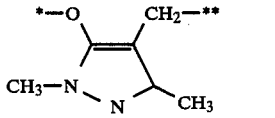

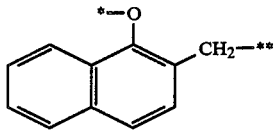

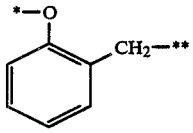

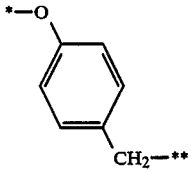

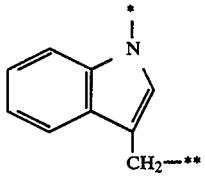

(4) A group utilizing a cleavage reaction by the hydrolysis of an ester:

Examples of this group are the linkage groups described in West German Patent Application (OLS) No. 2,626,315 and may be represented by the following formula (T-4) or (T-5):

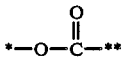

(T-4)

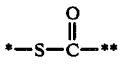

(T-5)

wherein, * and ** have the same significance as defined above in formula (T-1).

(5) a group utilizing a cleavage reaction of an iminoketal:

Examples of this group are the linkage groups described in U.S. Pat. No. 4,546,073 and may be represented by formula (T-6):

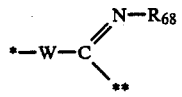

(T-6)

wherein * and ** have the same meaning as defined above for (T-1) and $R_{68}$ has the same meaning as $R_{67}$.

Specific examples of groups represented by formula (T-6) are as follows:

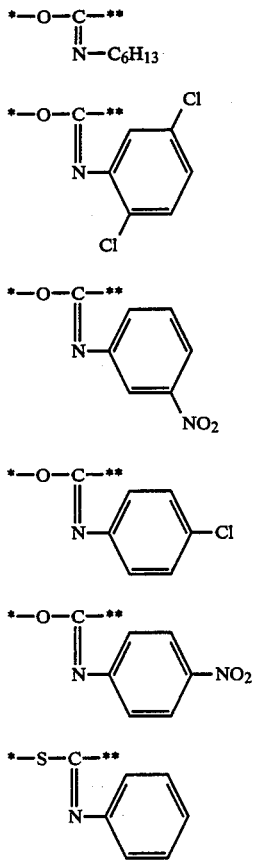

In formula (VI) described above, $L_2$ is a group which cleaves from the releasing group upon a reaction with the oxidation product of a color developing agent after being cleaved from A, and more specifically is a group becoming a coupler or an oxidation-reduction group after being cleaved from A.

The group becoming a coupler is as follows. That is, in the case of a phenolic coupler, the group is bonded to A at the oxygen atom of the hydroxy group thereof, removing the hydrogen atom. Also, in the case of a 5-pyrazolone type coupler, the group is bonded to A at the oxygen atom of the hydroxy group of the type tautomerized into 5-hydroxypyrazole, removing the hydrogen atom. In these examples, the group becomes a phenolic coupler or a 5-pyrazolone type coupler, respectively, after being released from A. Referring to formula (VI) the group has

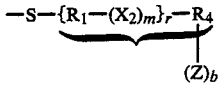

at the coupling position.

When $L_2$ represents group which becomes a coupler, the group is preferably represented by the following formulae (X), (XI), (XII) or (XIII), wherein * represents a position bonding to the left side moiety in formula (VI) and ** represents a position bonding to the right side moiety in formula (VI):

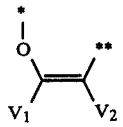

(X)

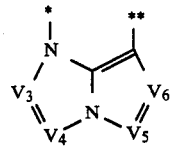

(XI)

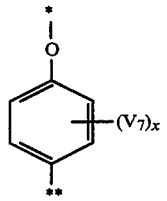

(XII)

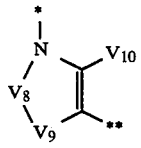

(XIII)

In the above formulae, $V_1$ and $V_2$, which may be the same or different, each represents a substituent; $V_3$, $V_4$, $V_5$ and $V_6$, which may be the same or different, each represents a nitrogen atom or a substituted or unsubstituted methine group; $V_7$ represents a substituent; and x represents an integer of from 0 to 4. When x is plural, $V_7$s may be the same or different and two $V_7$s may be combined with each other to form a cyclic structure. $V_8$ represents —CO—, —$SO_2$—, an oxygen atom, or a substituted imino group; $V_9$ represents a non-metallic atomic group for forming a 5-, to 8-membered ring together with

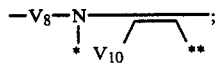

and $V_{10}$ represents a hydrogen atom or a substituent. In this case, $V_1$ and $V_2$ may represent divalent groups which may combine with each other to form a 5- to 8-membered ring together with

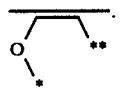

$V_1$ preferably represents the group defined hereinafter by $R_7$l and $V_2$- preferably represents the group defined by $R_{72}$, $R_{72}CO$—,

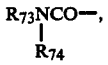

$R_{72}SO_2$— $R_{72}S$—, $R_{72}O$—, or

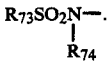

When $V_1$ and $V_2$ combine with each other to form a ring, examples of the ring are indenes, indoles, pyrazoles, and benzothiophenes.

When $V_3$, $V_4$, $V_5$, or $V_6$ represents a substituted methine group, examples of the preferred substituent are $R_{73}O$—, $R_{71}S$—, and $R_{71}CONH$—.

Preferred examples of $V_7$ are a halogen atom, $R_{71}$, $R_{71}CONH$—, $R_{71}SO_2NH$—, $R_{73}O$—, $R_{71}S$—,

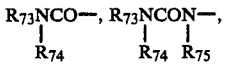

$R_{71}CO$—, and $R_{73}OOC$—.

When plural $V_7$s combine with each other to form a cyclic structure, examples thereof are naphthalenes, quinolines, oxyindoles, benzodiazepine-2,4-diones, benzimidazol-2-ones, and benzothiophenes.

When $V_8$ represents a substituted imino group it is preferably $R_{73}N<$.

When $V_9$ forms a ring structure with

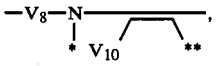

the preferred rings are indoles, imidazolinones, 1,2,5-thiadiazoline-l,l-dioxides, 3-pyrazolin-5-ones, 3-isoxazolin-5-ones, and

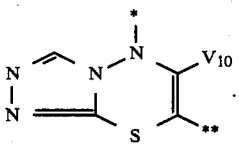

Preferred examples of $V_{10}$ are $R_{73}$, $R_{73}O$—,

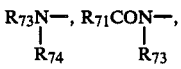

and $R_{71}S$—.

In the aforesaid formulae (X) to (XIII), $R_{71}$and $R_{72}$ each represents an aliphatic group, an aromatic group or a heterocyclic group and $R_{73}$, $R_{74}$ and $R_{75}$ each represents a hydrogen atom, an aliphatic group, an aromatic group, or a heterocyclic group. These aliphatic, aromatic and heterocyclic groups have the same meaning as defined above for $R_{41}$. In this case, however, the total carbon atom number included in each of these groups is preferably not more than 10.

Specific examples of groups represented by formula (X) are as follows:

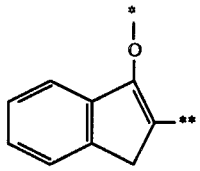

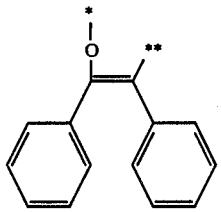

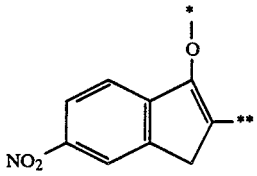

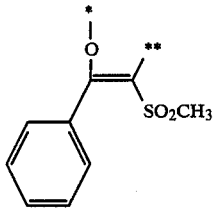

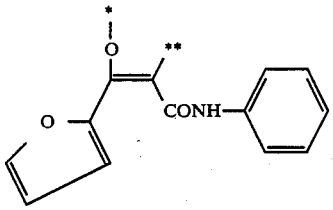

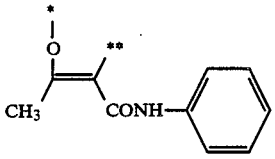

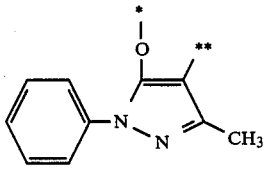

-continued
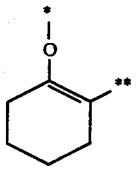
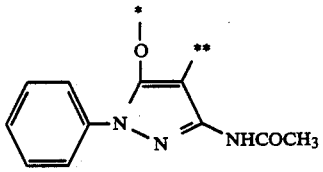
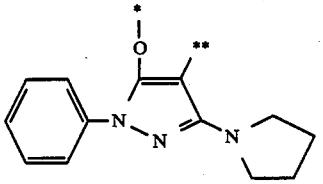
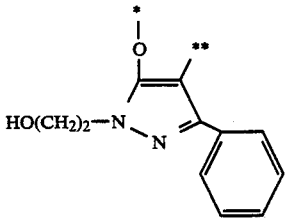
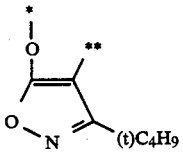
Specific examples of groups represented by formula (XI) are as follows:
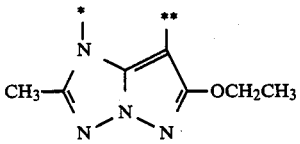
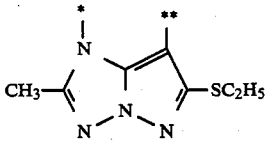
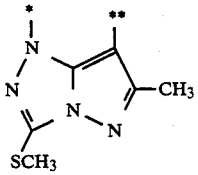
-continued
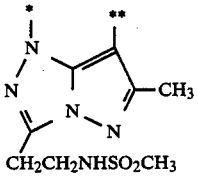
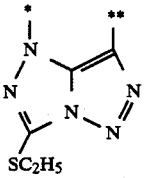
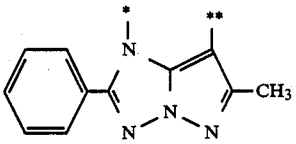
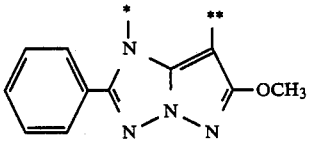
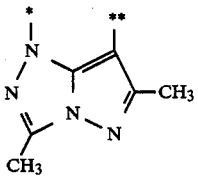
Specific examples of groups represented by formula (XII) are as follows:
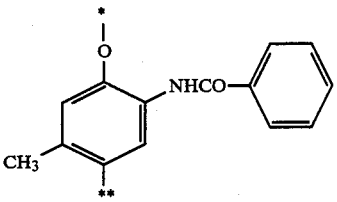
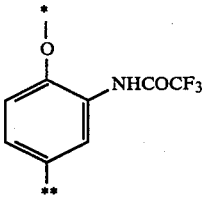
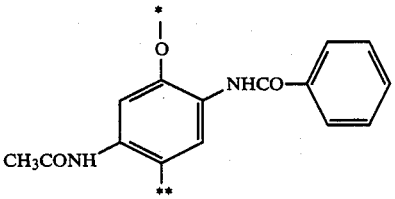

-continued

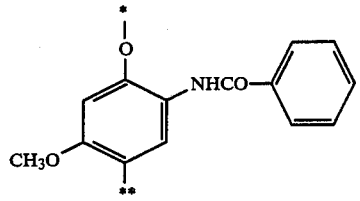

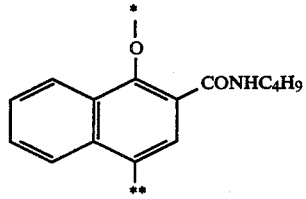

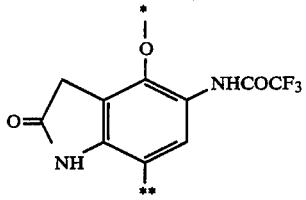

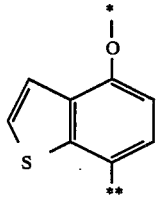

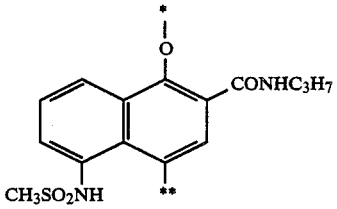

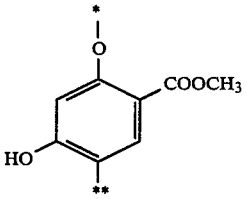

Specific examples of groups represented by formula (XIII) are as follows:

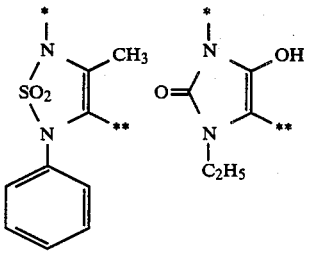

-continued

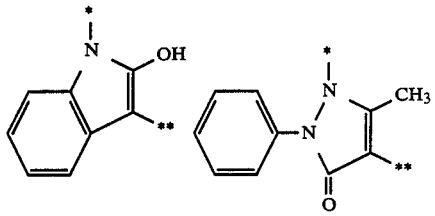

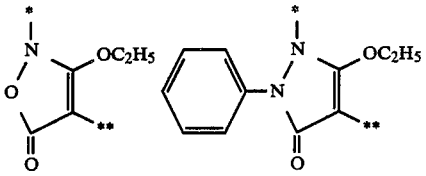

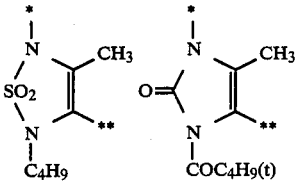

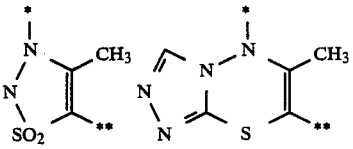

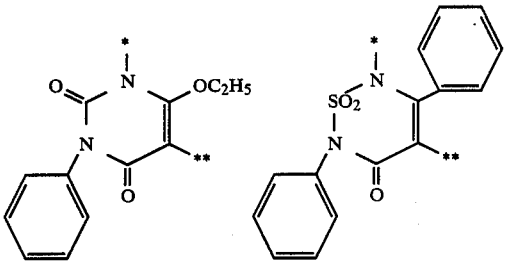

When $L_2$ in formula (VI) described above represents a group becoming an oxidation-reduction group, this group is preferably, represented by formula (XIV);

$$*—P'—(X'=Y')_{n'},Q'—A_2 \qquad \text{(XIV)}$$

wherein * represents a position bonding to the left side moiety in formula (VI); $A_2'$, P', A', and n' have the same meaning as $A_2$, P, Q and n, respectively, as defined in formula (VII); at least one of X' and Y' represents a methine group having $$—S—\{R_1—(X_2)_m\}_r—R_{34}$$
$$\qquad\qquad (Z)_b$$

as a substituent and other of X, and Y, represents a substituted or unsubstituted methine group or a nitrogen atom.

The group represented by formula (XIV) includes a case such that two of $A_2'$, P', Q', X', and Y' form a cyclic structure as divalent groups, and examples of such a cyclic structure are a benzene ring and a pyridine ring.

In formula (XIV) described above, P' preferably represents an oxygen atom and Q' preferably represents an oxygen atom or a group represented by following formulae

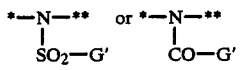

wherein * represents a bond to (X'=Y')n, and ** represents a bond to $A_2'$; and G' has the same meaning as G defined above in formulae (N-1) or (N-2).

In formula (XIV), Q' is particularly preferably an oxygen atom or a group shown by

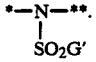

A particularly preferred group among the groups represented by formula (XIV) described above is represented by the following formulae (XV) or (XVI);

(XV)

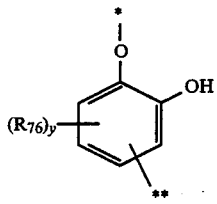

(XVI)

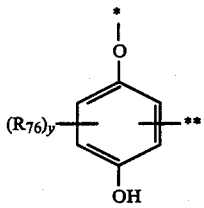

wherein * represents a position bonding to the left side moiety of $L_2$ in formula (VI) and ** represents a position bonding to the right side moiety thereof; $R_{76}$ has the same meaning as $R_{64}$ explained above in formulae (VIII) or (IX); and y represents an integer of from 0 to 3. When y is plural, plural $R_{76}$s may be the same or different. Also, the aforesaid group includes a case such that two $R_{76}$s may combine with each other to form a cyclic structure.

In formula (XVI), particularly preferred examples of $R_{76}$ are an alkoxy group (e.g., a methoxy group, an ethoxy group, etc.), an acylamino group (e.g., an acetamido group, a benzamido group, etc.), a sulfonamido group (e.g., a methanesulfonamido group, a benzenesulfonamido group, etc.), an alkylthio group (e.g., a methylthio group, an ethylthio group, etc.), a carbamoyl group (e.g., an N-propylcarbamoyl group, an N-t-butylcarbamoyl group, an N-i-propylcarbamoyl group, etc.), an alkoxycarbonyl group (e.g., a methoxycarbonyl group, a propoxycarbonyl group, etc.), an aliphatic group (e.g., a methyl group, a t-butyl group, etc.), a halogen atom (e.g., a fluorine atom, a chlorine atom, etc.), a sulfamoyl group (e.g., an N-propylsulfamoyl group, a sulfamoyl group, etc.), an acyl group (e.g., an acetyl group, a benzoyl group, etc.), a hydroxy group, and a carboxy group.

When two $R_{76}$s combine with each other to form a cyclic structure, a typical example of the cyclic structure is the group shown by the following formula

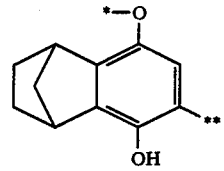

wherein * and ** have the same meaning as defined above in formula (XVI).

The bleach accelerator releasing compound shown by formulae (II) to (VI) in this invention includes a case such that the compound is a bis-compound, a telomer or a polymer.

Suitable polymers are prepared from a monomer represented by the following formula (XVII) and having a recurring unit represented by the following formula (XVIII) or a copolymer of the aforesaid monomer and at least one non-coloring monomer incapable of coupling with the oxidation product of an aromatic primary amine color developing agent and having at least one ethylene group. In this case, two or more kinds of the monomers shown by formula (XVII) may be simultaneously polymerized:

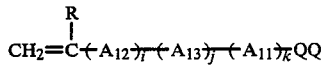

(XVII)

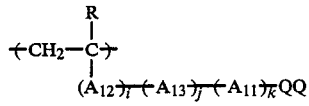

(XVIII)

wherein R represents a hydrogen atom, a lower alkyl group having from 1 to 4 carbon atoms or a chlorine atom; All represents —CONH—, —NHCONH—, —NHCOO—, —COO—, —$SO_2$—, —CO—, —NHCO—, —$SO_2$Nh—, —$NHSO_2$—, —OCO—, —OCONH—, —NH—, or —O—; $A_{12}$ represents —CONH— or —COO—; and $A_{13}$ represents a substituted or unsubstituted alkylene group having from 1 to 10 carbon atoms, a substituted or unsubstituted aralkylene group, or a substituted or unsubstituted arylene group and the alkylene group may be straight chain or branched.

Examples of the alkylene group are methylene, methylmethylene, dimethylmethylene, dimethylene, trimethylene, tetramethylene, pentamethylene, hexamethylene, and decylmethylene, examples of the aralkylene group are benzylidene, and examples of the arylene group are phenylene, and naphthylene.

In formulae (XVII) or (XVIII), QQ represents a residue of the compound shown by formula (II) to (VI) described above and the residue may be bonded at any site of the substituent excluding the group shown by Z.

In the aforesaid formula, i, and k represent 0 or 1 with the proviso that i, j, and k are not simultaneously 0.

When the aforesaid alkylene group, aralkylene group or arylene group is substituted, examples of the substituent are an aryl group (e.g., a phenyl group), a nitro group, a hydroxy group, a cyano group, a sulfo group, an alkoxy group (e.g., a methoxy group), an aryloxy group (e.g., a phenoxy group), an acyloxy group (e.g., an acetoxy group), an acylamino group (e.g., an acetylamino group), a sulfonamido group (e.g., a methanesulfonamido group), a sulfamoyl group (e.g., a methylsulfamoyl group), a halogen atom (e.g., fluorine, chlorine, and bromine), a carboxy group, a carbamoyl group (e.g., a methylcarbamoyl group), an alkoxycarbonyl group (e.g., a methoxycarbonyl group), and a sulfonyl group (e.g., as methylsulfonyl group). When two or more substituents are present, they may be the same or different.

Suitable non-coloring ethylenic monomers incapable of coupling with the oxidation product of an aromatic primary amine developing agent include acrylic acid, α-chloroacrylic acid, α-alkylacrylic acid, the esters or amides of these acids, methylenebisacrylamide, vinyl ester, acrylonitrile, aromatic vinyl compounds, maleic acid derivatives, and vinylpyridines. Two or more kinds of such non-coloring ethylenically unsaturated monomers may be used, if desired.

Particular examples of the bleach accelerator releasable from the bleach accelerator releasing compound for use in this invention are various mercapto compounds described in U.S. Pat. No. 3,893,858, British Patent No. 1,138,842,: and Japanese Patent Application (OPI) No. 141623/78, compounds having a disulfide bond as described in Japanese Patent Application (OPI) No. 95630/78, thiazolidine derivatives described in Japanese Patent Publication No. 9854/78, isothiourea derivatives described in Japanese Patent Application (OPI) No. 94927/78, thiourea derivatives as described in Japanese Patent Publication Nos. 8506/70 and 26586/74, thioamide compounds as described in Japanese Patent Application (OPI) No. 42349/74, dithiocarbamates as described in Japanese Patent Application (OPI) No. 26506/80, and arylenediamine compounds described in U.S. Pat. No. 4,552,834.

It is preferred that the aforesaid bleach accelerator is bonded to A—($L_1$)a— in formula (II) to (V) described above or A—$L_2$— in formula (V) at the substitutable hetero atom included in the molecule.

Specific examples of the compound releasing the bleach accelerator used in this invention are illustrated below, but the invention is not limited to these compounds.

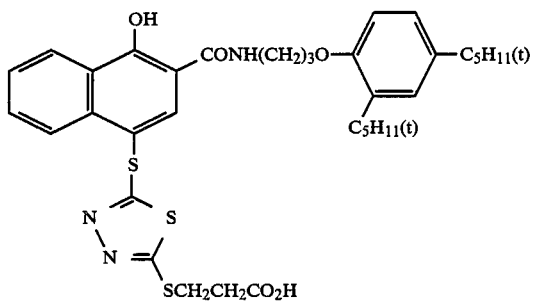

(1)

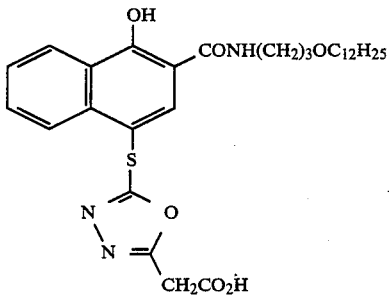

(2)

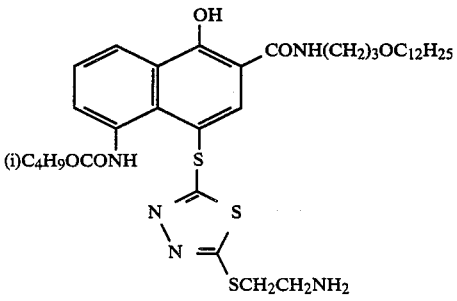

(3)

-continued
(4)
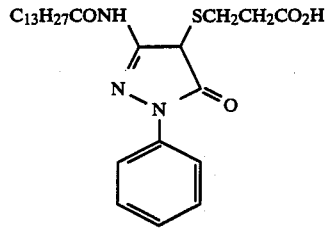
(5)
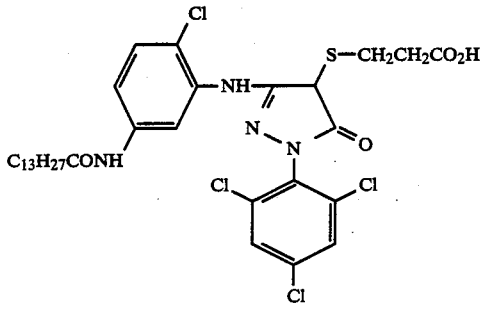
(6)
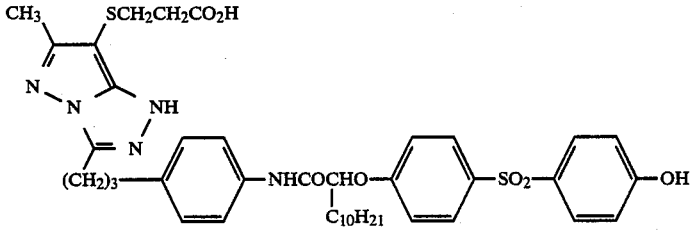
(7)
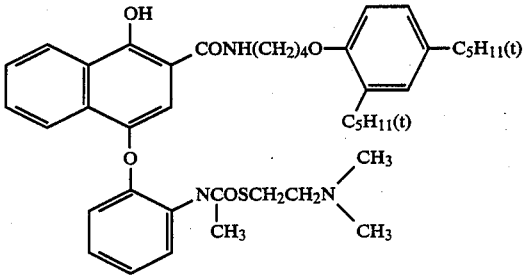
(8)
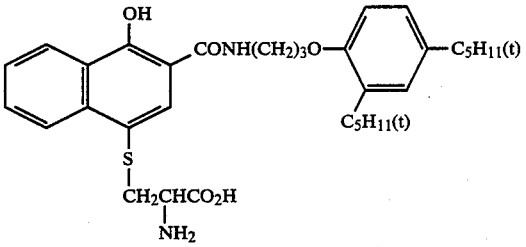
(9)
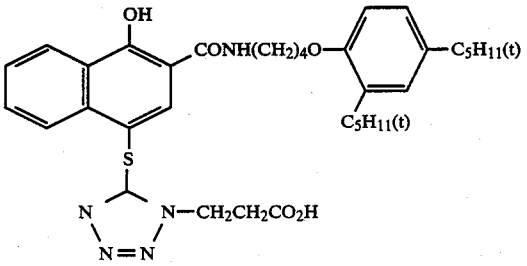

-continued
(10)
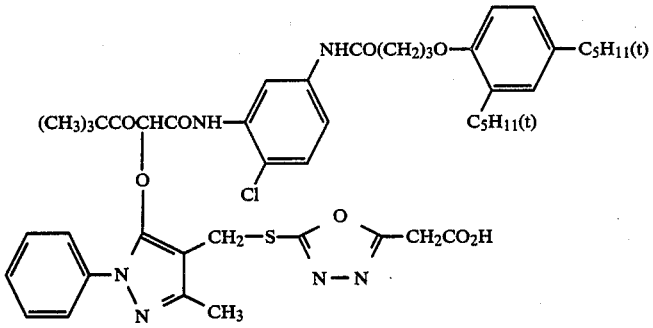
(11)
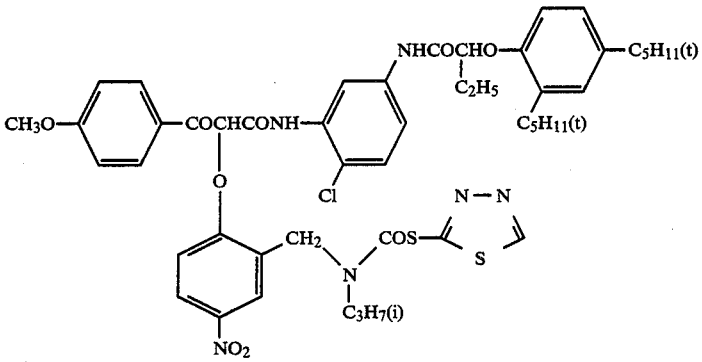
(12)
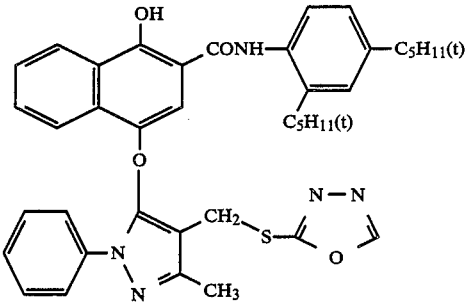
(13)
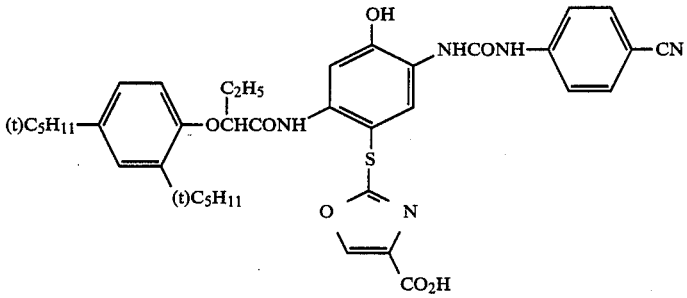
(14)
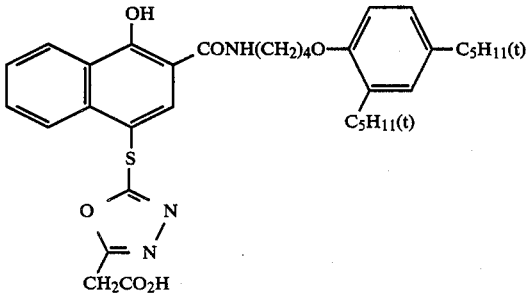

-continued
(15)
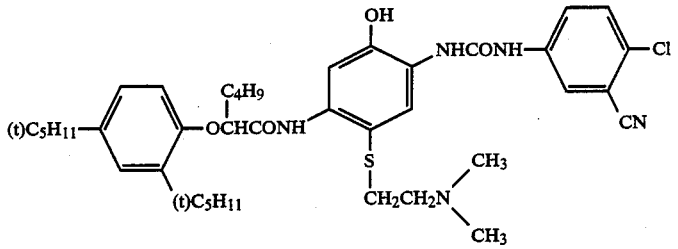
(16)
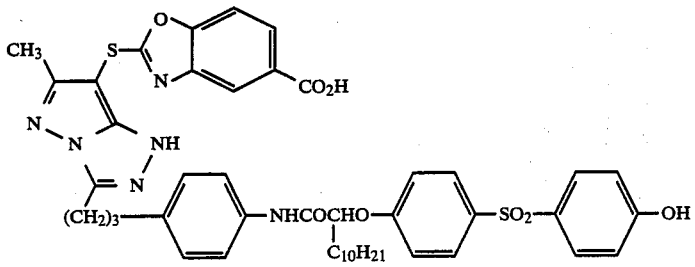
(17)
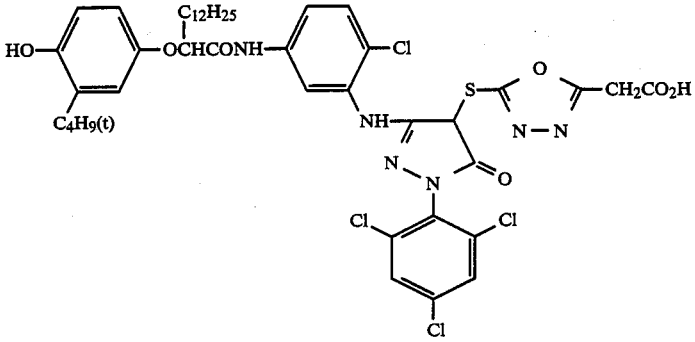
(18)
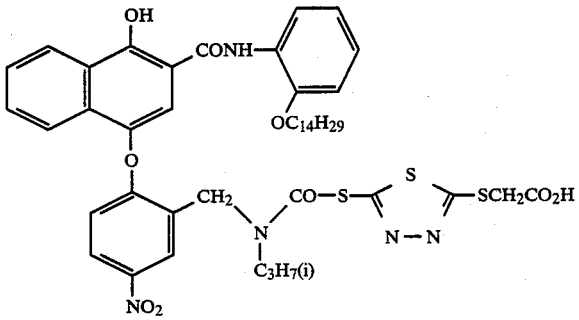
(19)
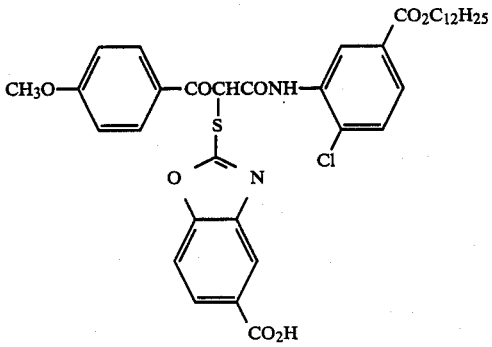

-continued
(20)
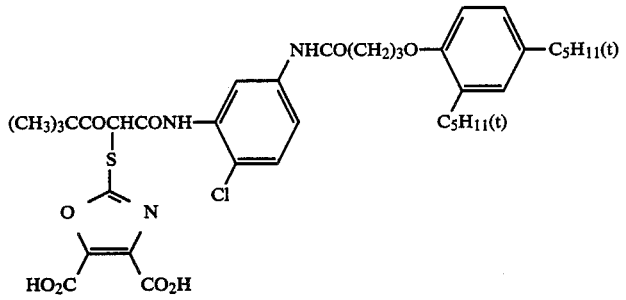
(21)
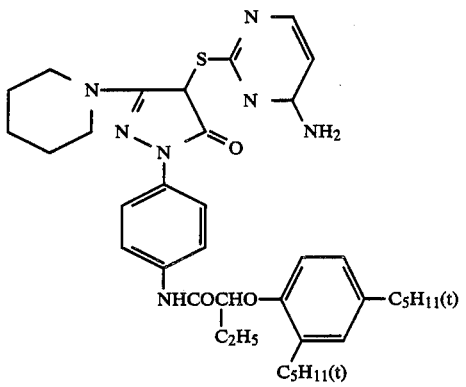
(22)
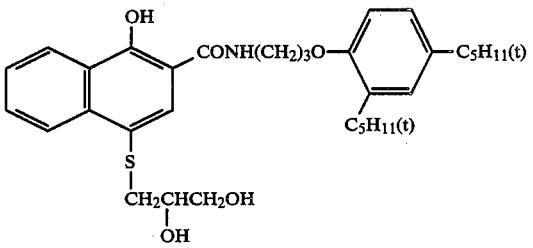
(23)
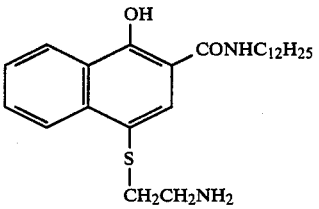
(24)
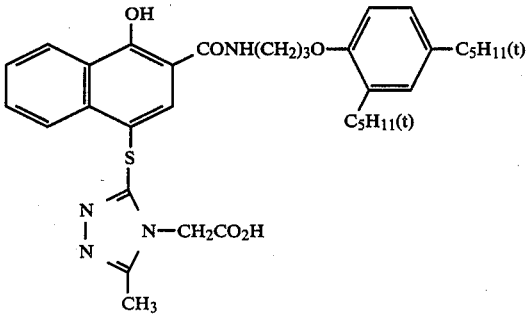

-continued
(25)
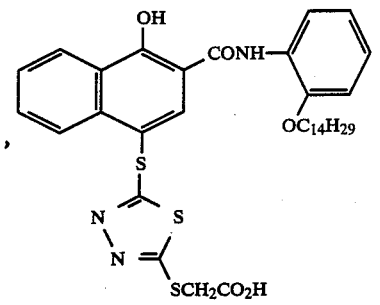
(26)
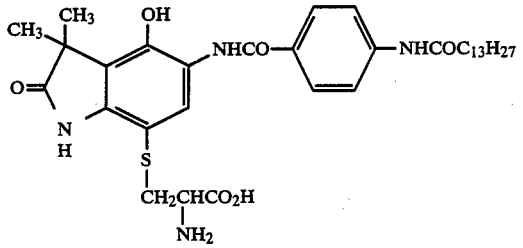
(27)
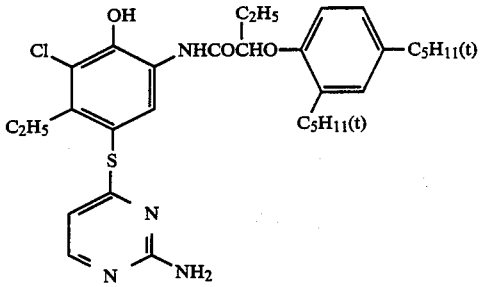
(28)
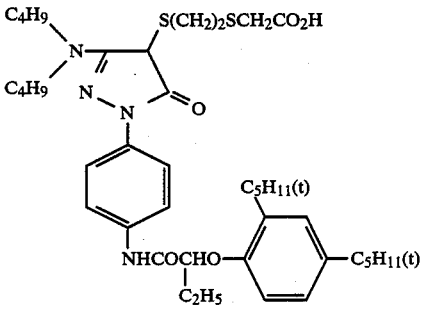
(29)
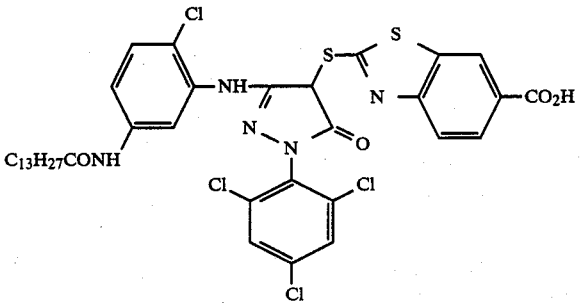

-continued
(30)
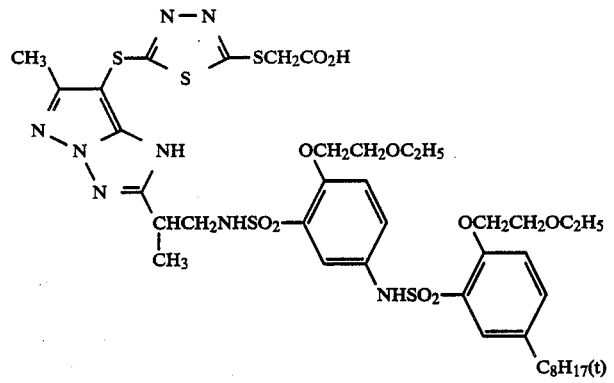
(31)
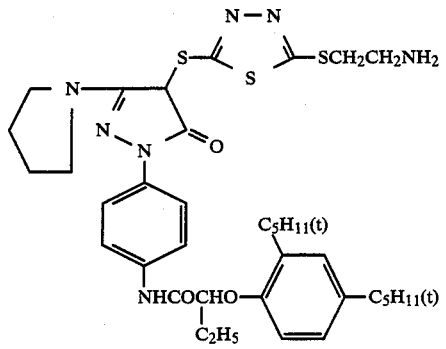
(32)
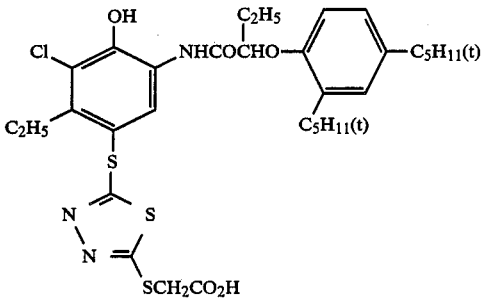
(33)
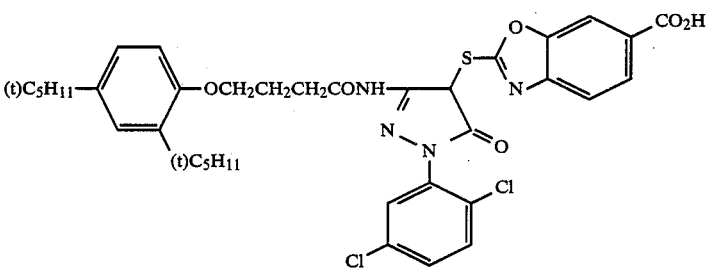
(34)
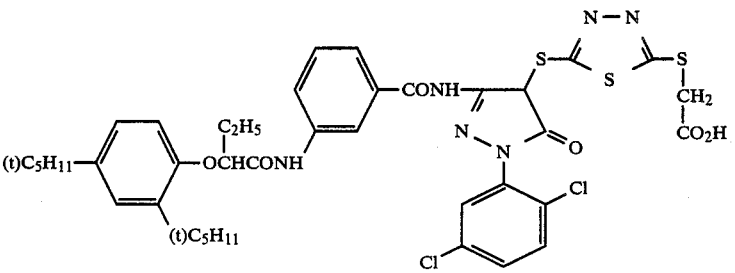

-continued
(35)
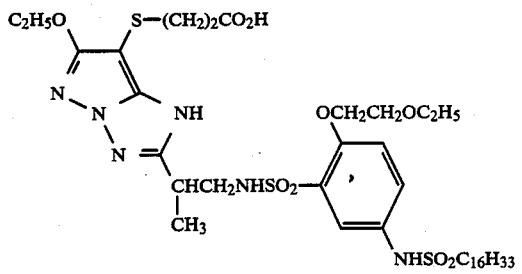
(36)
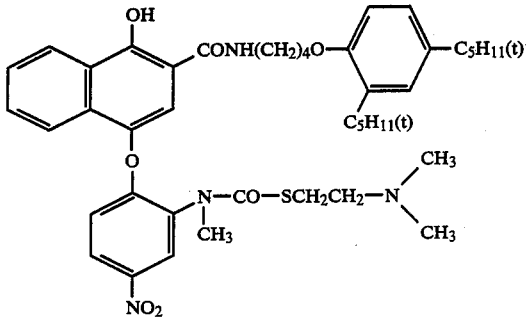
(37)
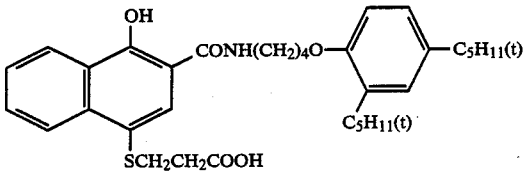
(38)
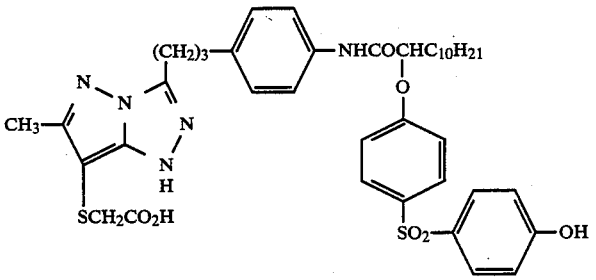
(39)
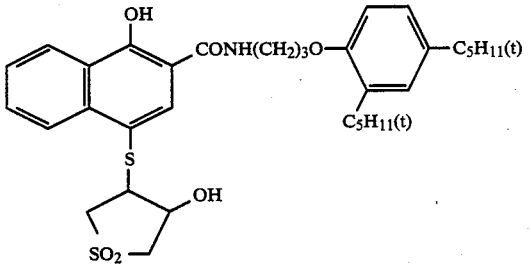
(40)
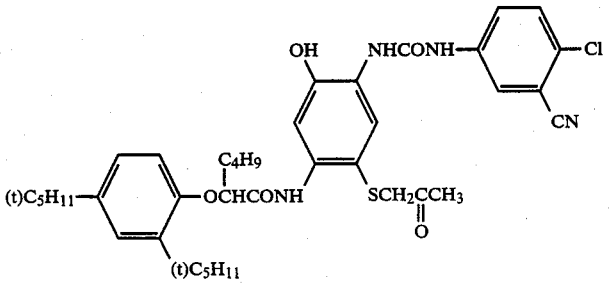

-continued
(41)
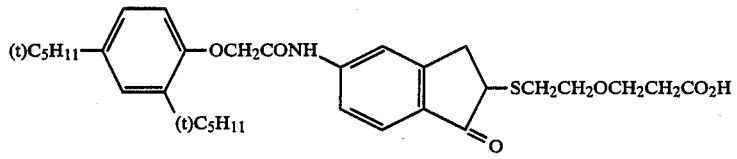
(42)
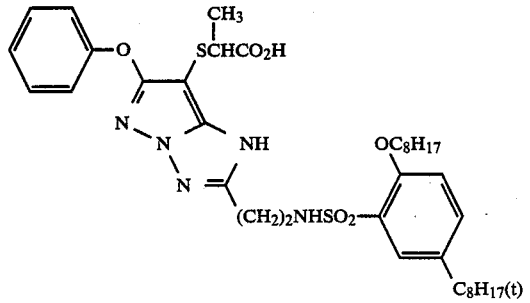
(43)
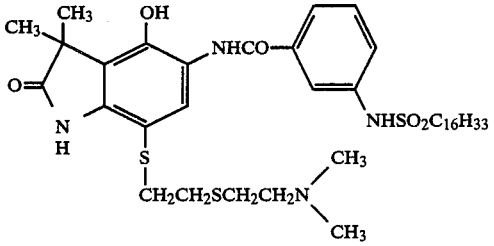
(44)
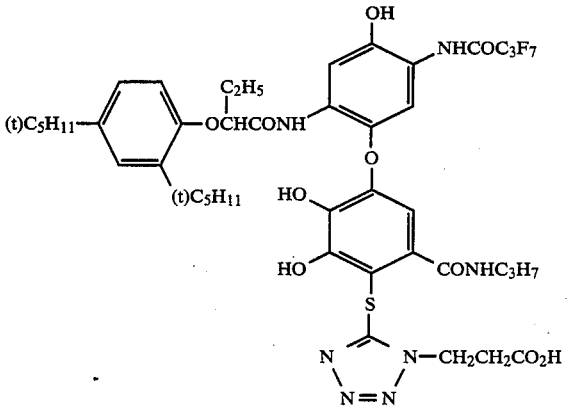
(45)
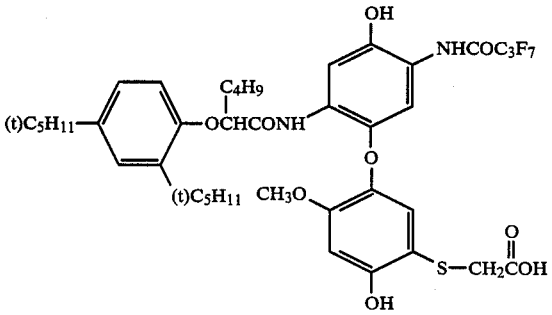

-continued
(46)
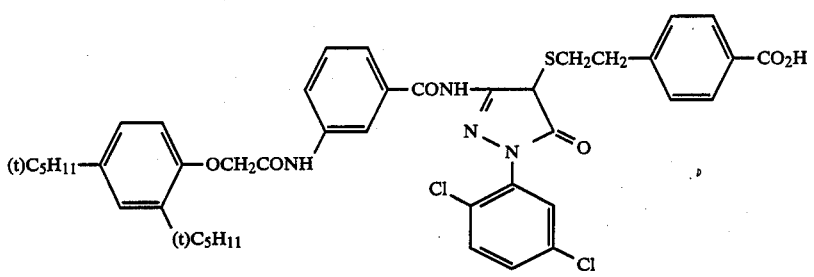
(47)
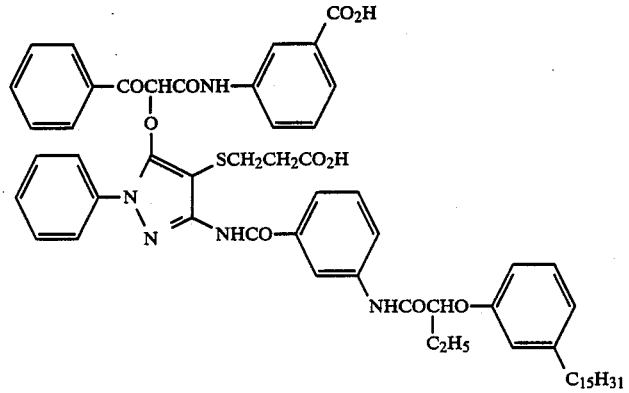
(48)
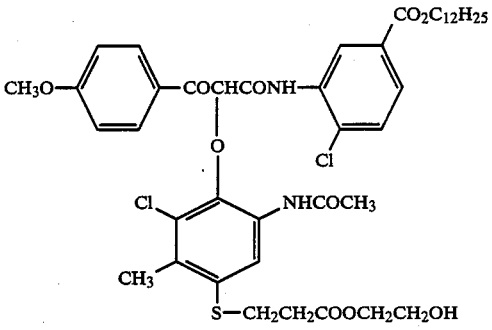
(49)
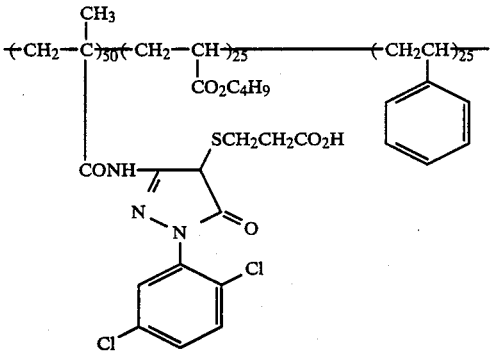
(50)
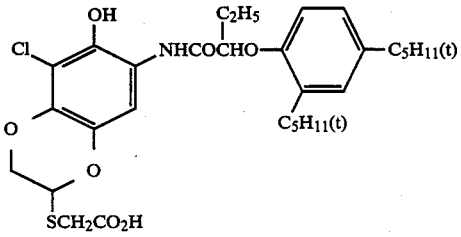

-continued
(51)
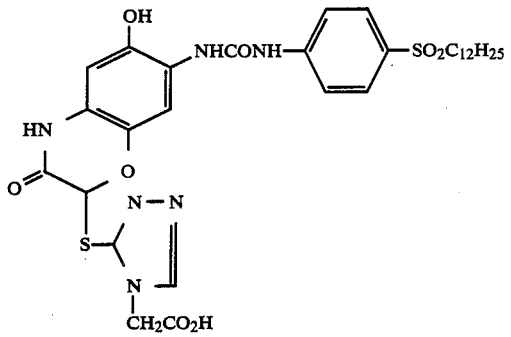
(52)
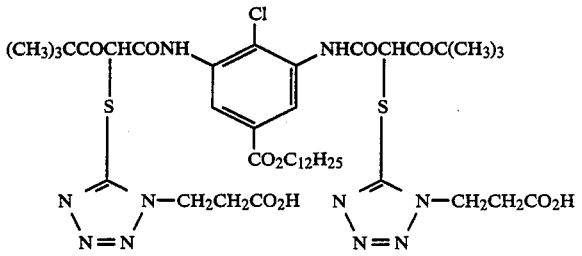
(53)
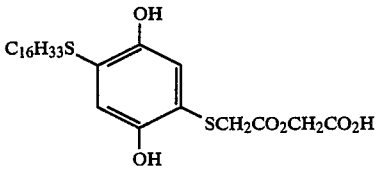
(54)
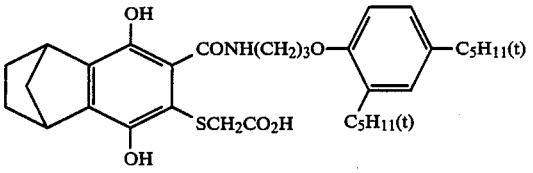
(55)
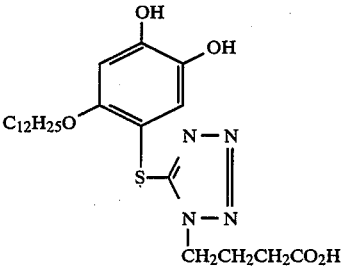
(56)
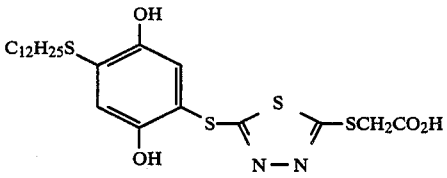
(57)
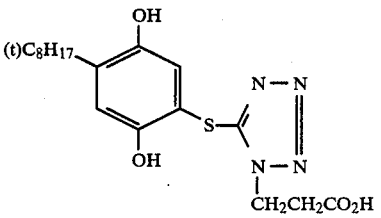

-continued
(58)
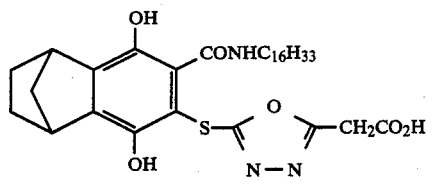
(59)
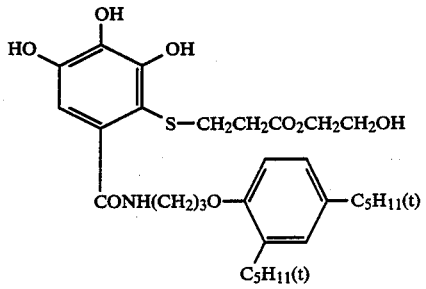
(60)
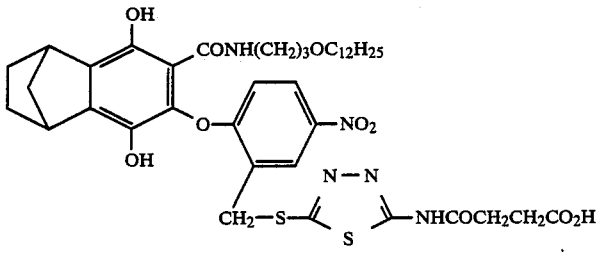
(61)
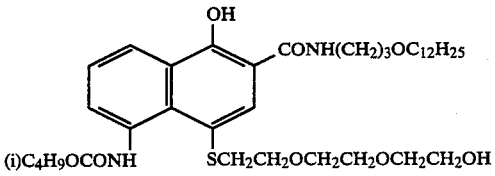
(62)
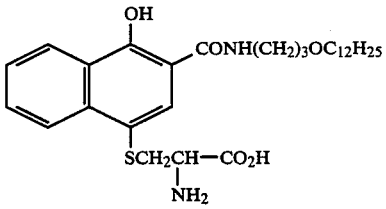
(63)
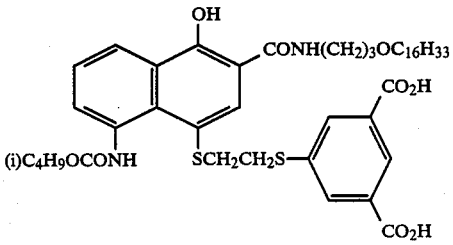

-continued (64)

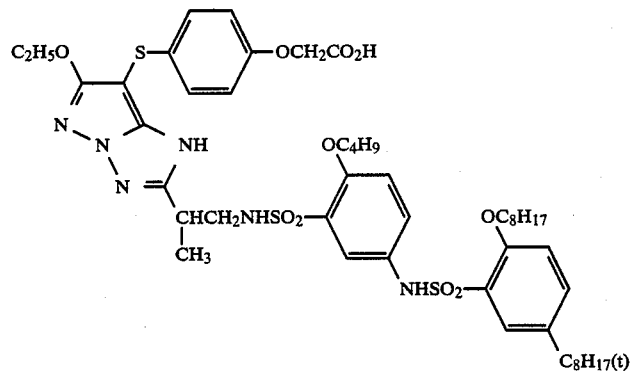

(65)

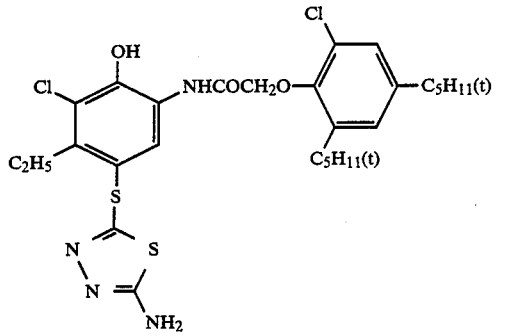

Other compounds, such as described in *Research Disclosure,* No. 24241, ibid., No. 11449, Japanese Patent Application (OPI) No. 201247/86, and Japanese Patent Application Nos. 252847/86, 268870/86 and 268871/86, can be also used as the bleach accelerator releasing compound in this invention.

The bleach accelerator releasing compounds for use in this invention can be easily synthesized based on the descriptions of the patent applications mentioned in the preceding paragraph which are expressly incorporated herein by reference.

The addition amount of the bleach accelerator releasing compound for use in this invention to a photographic light-sensitive material is preferably from about $1\times10^{-7}$ mol to $1\times10^{-1}$ mol, and particularly preferably from $1\times10^{-6}$ mol to $5\times10^{-2}$ mol per square meter of the light-sensitive material. The bleach accelerator releasing compound for use in this invention can be incorporated in any layer or layers of the color photographic light-sensitive material, but is preferably incorporated in one or more silver halide light-sensitive emulsion layer(s) and more remarkable effects are obtained by incorporating the compound in more than one light-sensitive emulsion layer.

Also, in this invention, by using bleach accelerator releasing compounds having a 5-amidonaphthol type or ureidophenol type structure (e.g., compounds (3), (13), (15), (61), (63), etc.), the recoloring property is more effectively improved.

Cyan dye-forming couplers represented by formula (A) described above, which are used in this invention, are described in detail below.

In formula (A), $R_1$ is a substituted or unsubstituted aliphatic group, a substituted or unsubstituted aromatic group, or a substituted or unsubstituted heterocyclic group. The aliphatic group is preferably an aliphatic group which includes a straight chain, branched or cyclic alkyl group, alkenyl group or alkynyl group, any of which may be substituted or unsubstituted. The aromatic group is preferably a substituted or unsubstituted aryl group, which may be a condensed ring. The heterocyclic group is preferably a substituted or unsubstituted monocyclic or condensed heterocyclic group.

In formula (A), $R_1$ preferably represents an aliphatic group having from 1 to 36 carbon atoms, an aromatic group having from 6 to 36 carbon atoms, or a heterocyclic group having from 2 to 36 carbon atoms and is more preferably a tertiary alkyl group having from 4 to 36 carbon atoms or a group represented by the following formula (B) having from 7 to 36 carbon atoms:

(B)

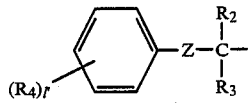

wherein $R_2$ and $R_3$, which may be the same or different, each represents a hydrogen atom, an aliphatic group having from 1 to 30 carbon atoms or an aromatic group having from 6 to 30 carbon atoms; $R_4$ represents a monovalent group; Z represents —O—, —S—, —SO—, or —$SO_2$—; and l' represents an integer of from 0 to 5. When l' is plural, plural $R_4$s may be the same or different.

In a preferred embodiment of the group represented by formula (A), $R_2$ and $R_3$ are a straight chain or branched alkyl group having from 1 to 18 carbon atoms; $R_4$ is a halogen atom, an aliphatic group, an aliphatic oxy group, a carbonamido group, a sulfonamido group, a carboxy group, a sulfo group, a cyano group, a hydroxy group, a carbamoyl group, a sulfamoyl group, an aliphatic oxy carbonyl group, or an aromatic sulfonyl group; and Z is —O—. In this case, the carbon atom number of the group shown by $R_4$ is from 0 to 30 and l' is preferably from 1 to 3. $R_1$ is particularly preferably a 1-(2,4-tert-aminophenoxy)pentyl group, a 1-(2,4-di-tert-anylphenoxy)haptyl group, a tert-butyl group, etc.

In formula (A) described above, X represents a hydrogen atom or a coupling releasing group (including a releasing atom). Typical examples of the coupling releasing group are a halogen atom, $-OR_5$, $-SR_5$, $$-OCR_5\underset{\underset{O}{\|}}{}, -NHCOR_5, -NHC\underset{\underset{O}{\|}}{}SR_5, -OC\underset{\underset{O}{\|}}{}-OR_5, -OC\underset{\underset{O}{\|}}{}NHR_5,$$

an aromatic azo group having from 6 to 30 carbon atoms, or a heterocyclic group having from 1 to 30 carbon atoms and bonding to the coupling active position by a nitrogen atom thereof (e.g., a succinamido group, a phthalimido group, a hydrantoinyl group, a pyrazolyl group, a 2-benzothriazolyl group, etc.). $R_5$ represents an aliphatic group having from 1 to 30 carbon atoms, an aromatic group having from 6 to 30 carbon atoms or a heterocyclic group having from 2 to 30 carbon atoms.

The aliphatic group defined herein for $R_5$ may be a saturated or unsaturated, substituted or unsubstituted, and straight chain, branched or cyclic aliphatic group as described above for $R_1$ and typical examples thereof are a methyl group, an ethyl group, a butyl group, a cyclohexyl group, an allyl group, a propargyl group, a methoxyethyl group, a n-decyl group, a n-dodecyl group, a n-hexadecyl group, a trifluoromethyl group, a heptafluoropropyl group, a dodecyloxypropyl group, a 2,4-di-tert-amylphenoxypropyl group and a 2,4-di-tert-amylphenoxybutyl group.

Also, the aromatic group for $R_5$ may be substituted or unsubstituted as described above and typical examples are a phenyl group, a tolyl group, a 2-tetradecyloxyphenyl group, a pentafluorophenyl group, a 2-chloro-5-dodecyloxycarbonylphenyl group, a 4-chlorophenyl group, a 3-cyanophenyl group, and a 4-hydroxyphenyl group.

Furthermore, the heterocyclic group for $R_5$ may be subsituted or unsubstituted and typical examples thereof are a 2-pyridyl group, a 4-pyridyl group, a 2-furyl group, a 4-thienyl group, and a quinolinyl group.

In formula (A), X is particularly preferably a hydrogen atom, a halogen atom, an aliphatic oxy group having from 1 to 30 carbon atoms (e.g., a methoxy group, a 2-methanesulfonamidoethoxy group, a 2-methanesulfonylethoxy group, a carboxymethoxy group, a 3-carboxypropyloxy group, a 2-carboxymethylthioethoxy group, a methoxyethoxy group, and a 2-methoxyethylcarbamoylmethoxy group), an aromatic oxy group (e.g., a phenoxy group, a 4-chlorophenoxy group, a 4-(3-carboxypropanamido)phenyl group, a 4-methoxyphenoxy group, a 4-tertoctylphenoxy group, and a 4-carboxyphenoxy group), an aliphatic thio group (e.g., a 2-carboxyethylthio group and a 1-carboxyundecylthio group), a heterocyclic thio group (e.g., a 5-phenyl-l,2,3,4-tetrazolyl-l-thio group, a 5-amino-l,3,4-thiadiazol-2-ylthio group, and a 5-ethyl-1,2,3,4-tetrazolyl-l-thio group), or an aromatic azo group (e.g., a 4-dimethylaminophenylazo group, a 4-acetamidophenylazo group, a 1-naphthylazo group, a 2-ethoxycarbonylphenylazo group, and a 2-methoxycarbonyl-4,5-dimethoxyphenylazo group).

In formula (A), Ar represents an aromatic group having at least one substituent, and is preferably a substituted aryl group, which may be a condensed ring (e.g., a naphthalene ring). The aryl group preferably has 1 to 5 substituents.

Furthermore, Ar is preferably represented by formula (C):

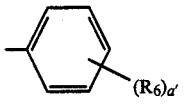

(C)

wherein $R_6$ represents a substituent group and a' represents an integer of from 1 to 3. In this case, however, the total sum ($\Sigma\sigma$) of the values ($\sigma_m$ values and/or $\sigma_p$ values) of $R_6$ is at least 0.67.

When a substituent exists at the ortho-position, such a substituent is not considered in the calculation of $\Sigma\sigma$.

When n is plural, $nR_6$s may be the same or different.

In addition, the $\sigma_m$ value and $\sigma_p$ value are described, for example, in C. Hansch, A. Leo, S. H. Unger, K. H. Kim, D. Nitaitani, and E. J. Lien, *Journal of Medical Chemistry,* 16, 1207 (1973), and C. Hansch, S. D. Rockwell, P. Y. C. Tow, A. Leo, and E. E. Steller, ibid., 20, 304 (1977), and the literature cited therein.

Preferred examples of the group shown by $R_6$ meeting the aforesaid condition of $\Sigma\sigma$ are a halogen atom (e.g., fluorine atom, chlorine atom, bromine atom, and iodine atom), a cyano group, a nitro group, an alkyl group (e.g., a trifluoromethyl group, a chloromethyl group, a bromomethyl group, a trichloromethyl group, and a cyanomethyl group), an alkylsulfonyl group (e.g., a methylsulfonyl group, an ethylsulfonyl group, a propylsulfonyl group, a n-butylsulfonyl group, a trifluoromethylsulfonyl group, and a 2-chloroethylsulfonyl group), an arylsulfonyl group (e.g., a phenylsulfonyl group, a p-tolylsulfonyl group, a 4-methoxyphenylsulfonyl group, and a 4-chlorophenylsulfonyl group), an alkoxy group (e.g., a methoxy group, an ethoxy group, and a trifluoromethoxy group), an acyl group (e.g., a formyl group, an acetyl group, a benzoyl group, a trifluoroacetyl group, a pentafluorobenzoyl group, and a trichloroacetyl group), an acyloxy group (e.g., an acetoxy group and a benzoyloxy group), an alkoxycarbonyl group (e.g., a methoxycarbonyl group and an ethoxycarbonyl group), a carbamoyl group (e.g., a carbamoyl group, an N-methylcarbamoyl group and an N,N-dimethylcarbamoyl group), a sulfamoyl group (e.g., a sulfamoyl group, an N-methylsulfamoyl group, and an N,N-dimethylsulfamoyl group), a carbonamido group (e.g., a formamido group, an acetamido group, a trifluoroacetamido group, a benzamido group, a pentafluorobenzamido group, and a 4-nitrobenzamido group), a sulfonamido group (e.g., a methanesulfonamido group, a trifluoromethanesulfonamido group, a p-toluenesulfonamido group), an alkylsulfinyl group (e.g., a methylsulfinyl group and a trifluoromethylsulfinyl group), an arylsulfinyl group (e.g., a phenylsulfinyl group and a p-tolylsulfinyl group), a thiocyanate group, a carboxy group, a sulfo group, an alkylthio group (e.g., a methylthio group and a trifluoromethylthio group), and an arylthio group (e.g., a phenylthio group and a 4-nitrophenylthio group). Among these groups, a halogen atom, a cyano group, an alkoxy group, a sulfamoyl group, a sulfonamido group and an alkylsulfonyl group are preferred, and a halogen atom, a cyano group and an alkylsulfonyl group are particularly preferred.

Specific examples of Ar are illustrated below, wherein the numeral in the parentheses is the value of $\Sigma\sigma$.

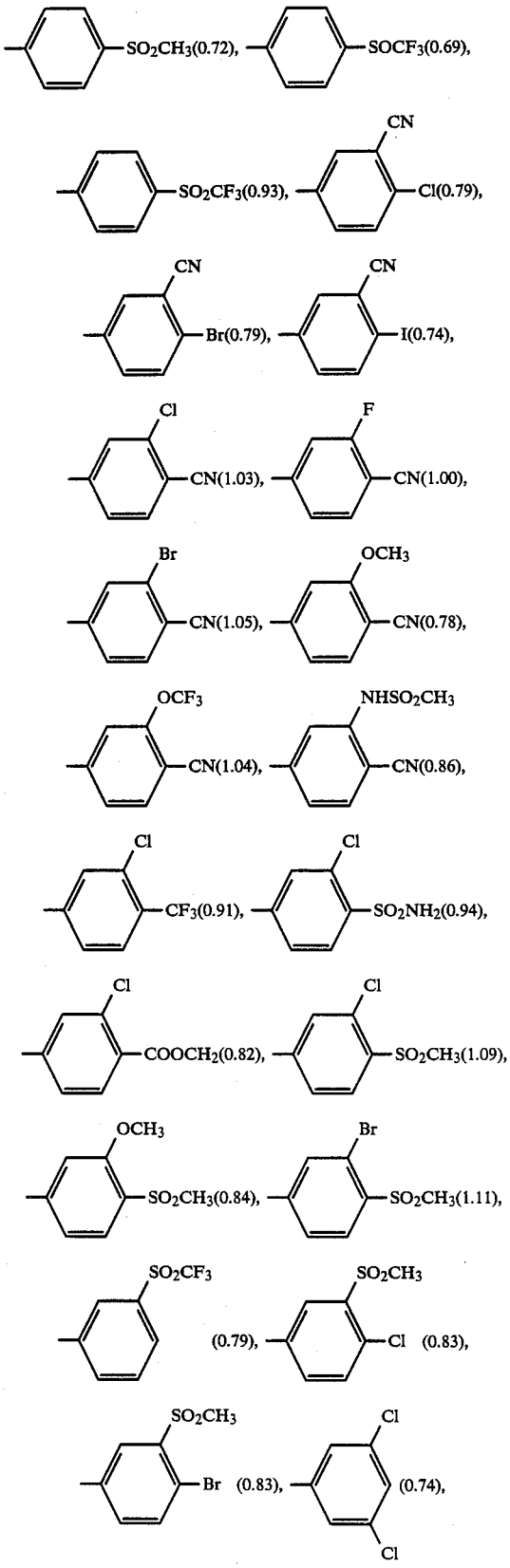

-continued

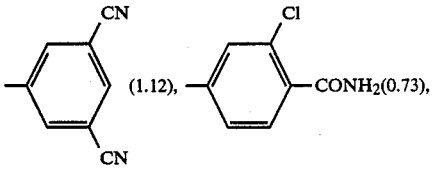

In Ar having $\Sigma\sigma$ of at least 0.67, Ar having $\Sigma\sigma$ of at least 0.70 is preferred and Ar having $\Sigma\sigma$ of at least 0.75 is particularly preferred.

The couplers represented by formula (A) may form a dimer, an oligomer or a higher polymer bonded through a divalent or higher group at $R_1$, Ar or X. In this case, the total carbon atom number may be outside the range defined for each substituent.

When the coupler represented by formula (A) forms a polymer, a homopolymer or copolymer of an addition polymerizable ethylenically unsaturated compound having a cyan dye forming coupler residue a cyan coloring monomer) is typical. In this case, the polymer has a recurring unit represented by the following formula (D). The cyan coloring recurring unit represented by formula (D) may exist in the polymer alone or as two or more kinds thereof, or may be present in a copolymer of one or more kinds of non-coloring ethylenic monomers as a copolymerizable component:

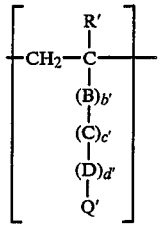

(D)

wherein R' represents a hydrogen atom, an alkyl group having from 1 to 4 carbon atoms, or a chlorine atom; B represents —CONH—, —COO— or a substituted or unsubstituted phenylene group; C represents a substituted or unsubstituted alkylene group, a substituted or unsubstituted phenylene group or a substituted or unsubstituted aralkylene group; D represents —CONH—, —NHCONH—, —NHCOO—, —NHCO—, —OCONH—, —NH—, —COO—, —OCO—, —CO—, —O—, —$SO_2$—, —$NHSO_2$— or —$SO_2Nh$—; b', c', and d' each represents 0 or 1; and Q' represents a cyan coupler residue which is the compound shown by formula (A) from which other hydrogen atoms than the hydrogen atom of the hydroxy group are released.

As the aforesaid monomer, a copolymer of the cyan-coloring monomer giving the coupler unit shown by formula (D) and a non-coloring ethylenically unsaturated monomer described below is preferred.

That is, as the non-coloring ethylenically unsaturated monomer incapable of coupling with the oxidation product of an aromatic primary amine developing agent, there are acrylic acid, α-chloroacrylic acid, α-alkylacrylic acid (e.g., methacrylic acid, etc.), esters or amides of the aforesaid acrylic acids (e.g., acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and α-hydroxy methacrylate), vinyl esters (e.g., vinyl acetate, vinyl propionate, and vinyl laurate), acrylonitrile, methacrylonitrile, aromatic vinyl compounds (e.g., styrene and derivatives thereof such as vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid esters, N-vinyl-2-pyrrolidone, N-vinylpyridine, and 2- or 4-vinylpyridine.

Among these monomers, acrylic acid esters, methacrylic acid esters, and maleic acid esters are preferred.

The aforesaid non-coloring ethylenic monomers may be used as a combination thereof, such as methyl acrylate and butyl acrylate, butyl acrylate and styrene, butyl methacrylate and methacrylic acid, and methyl acrylate and diacetonacrylamide.

As is well known in the field of polymer couplers, the non-coloring ethylenically unsaturated monomer(s) being copolymerized with the vinylic monomer corresponding to the monomer represented by formula (D) can be selected so that they provide good influences on the physical properties and/or the chemical properties of the copolymer formed, such as the solubility, the compatibility with a binder for photographic colloid compositions, such as gelatin, the softening temperature, plasticity, heat stability, etc., thereof.

The cyan polymer coupler for use in this invention may be prepared by emulsion-dispersing a solution of the oleophilic polymer coupler obtained b the polymerization of the vinylic monomer giving the coupler unit shown by formula (D) dissolved in an organic solvent in an aqueous gelatin solution as the form of latex or may be prepared by a direct emulsion polymerization method.

For emulsion-dispersing the oleophilic polymer coupler in an aqueous gelatin solution as the form of latex, the method described in U.S. Pat. No. 3,451,820 can be used and for the emulsion polymerization, the method described in U.S. Pat. Nos. 4,080,211 and 3,370,952 can be used.

Specific examples of the cyan dye forming coupler represented by formula (A) described above, which can be used in this invention, are illustrated below although the invention is not limited to them.

(A-1)

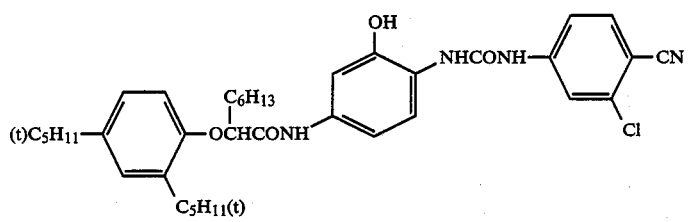

(A-2)

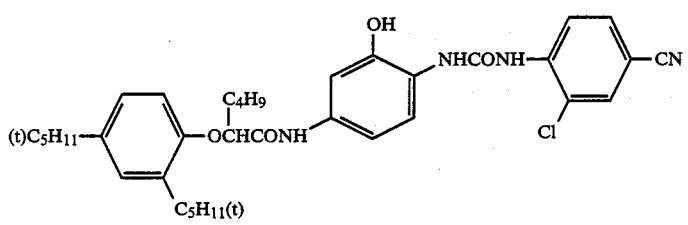

(A-3)

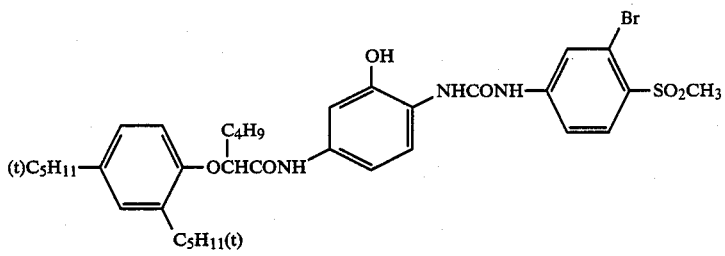

(A-4)

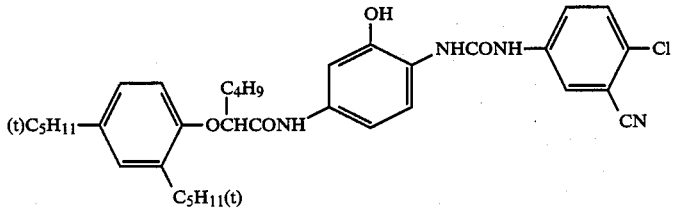

-continued
(A-5)
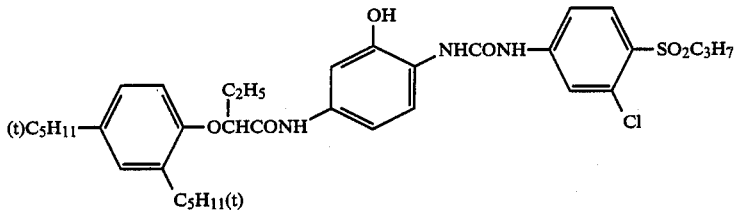
(A-6)
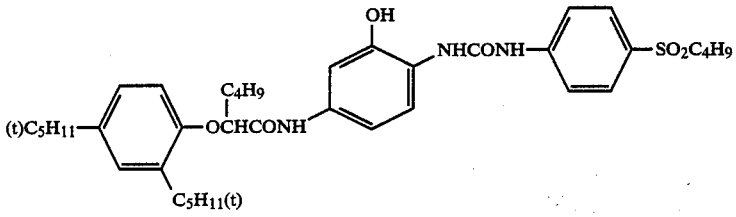
(A-7)
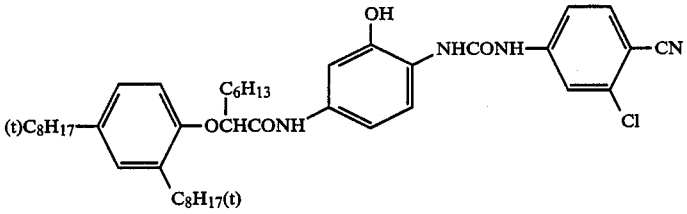
(A-8)
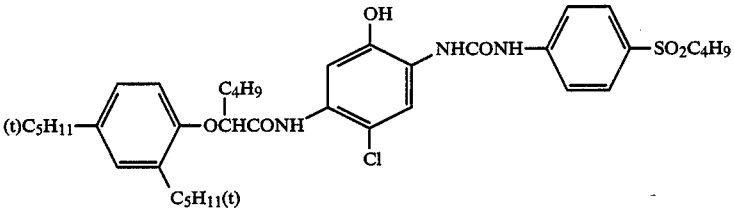
(A-9)
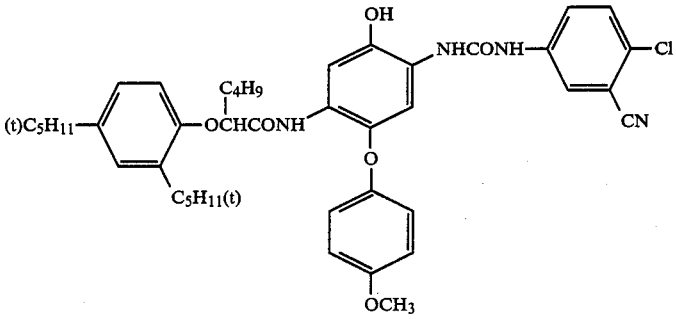
(A-10)
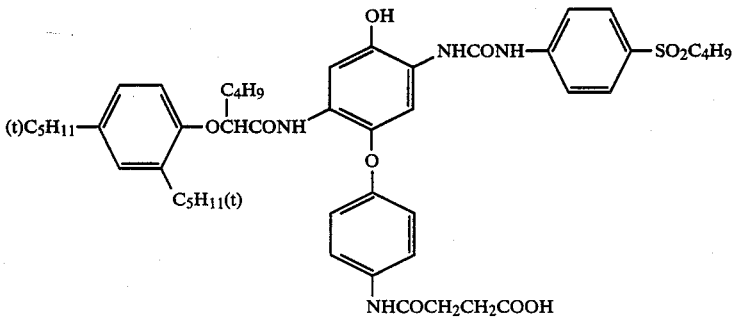

-continued
(A-11)
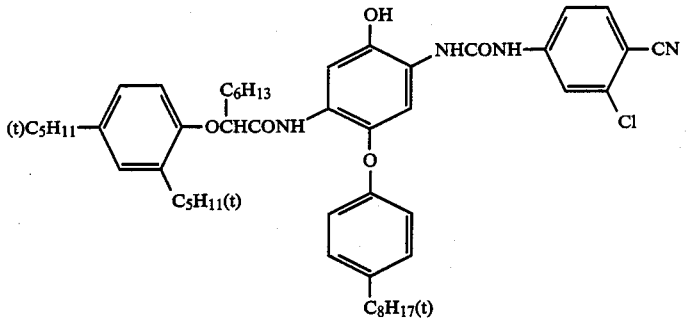
(A-12)
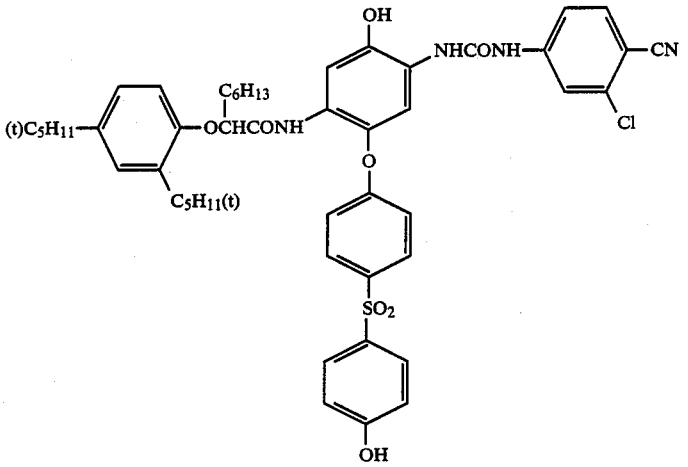
(A-13)
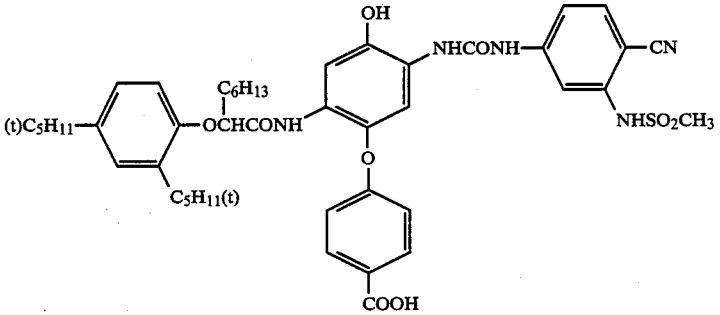
(A-14)
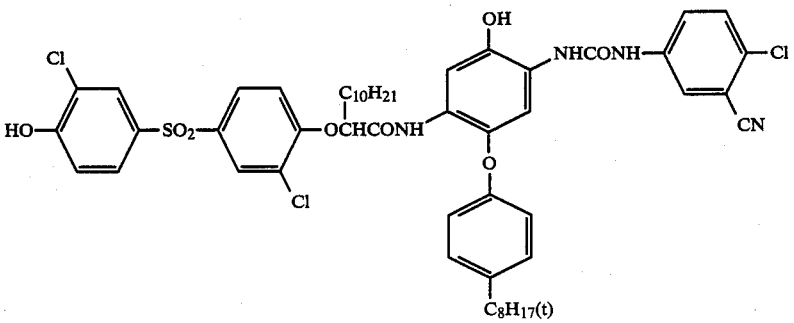

-continued
(A-15)
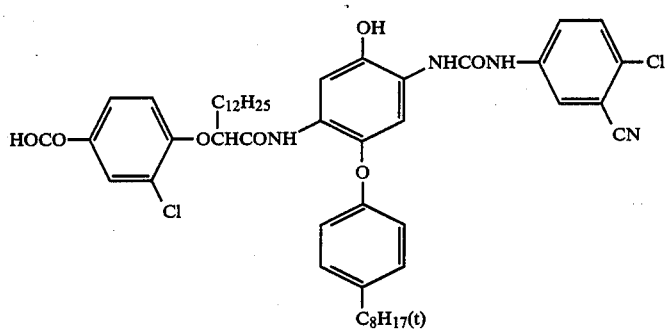
(A-16)
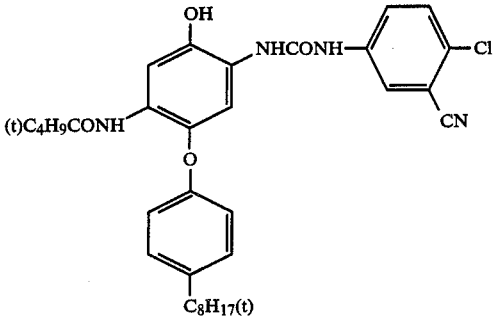
(A-17)
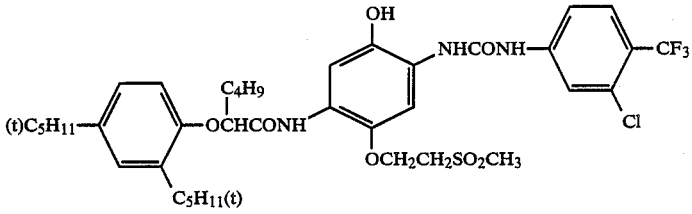
(A-18)
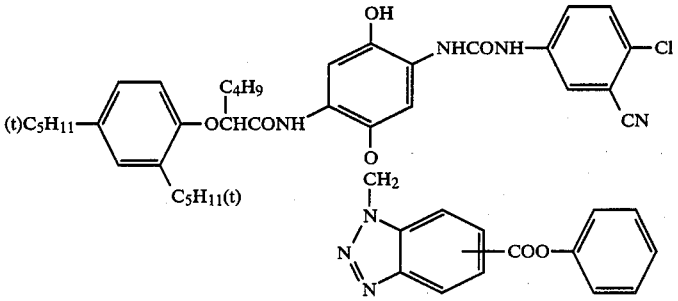
(A-19)
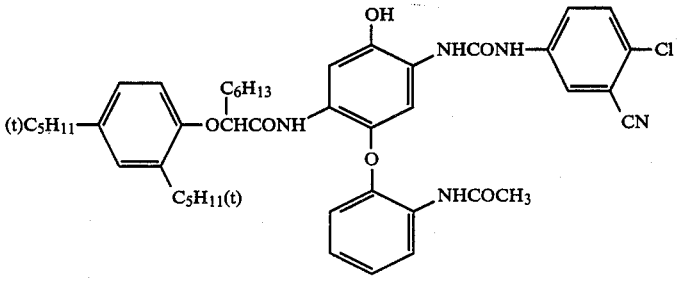

-continued
(A-20)
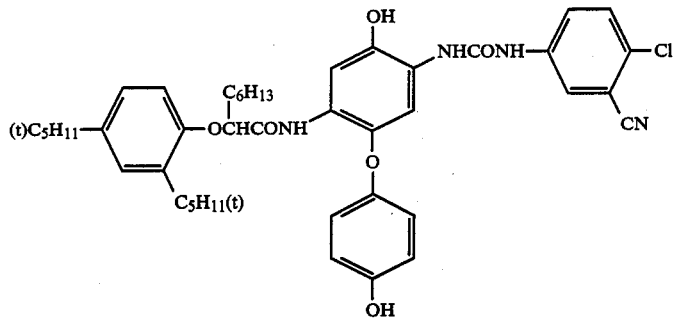
(A-21)
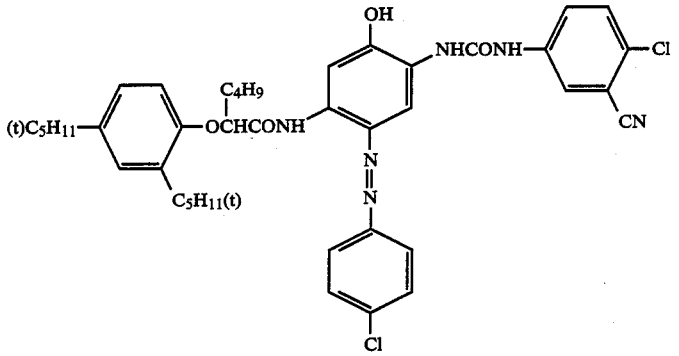
(A-22)
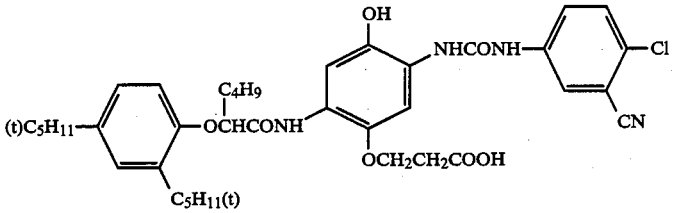
(A-23)
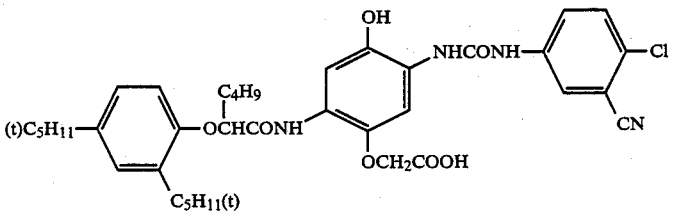
(A-24)
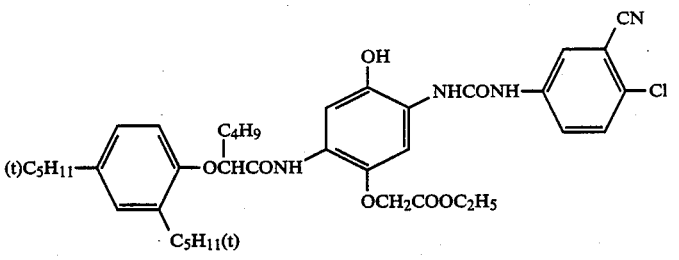
(A-25)
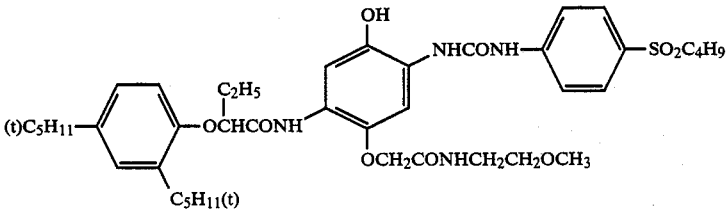

-continued

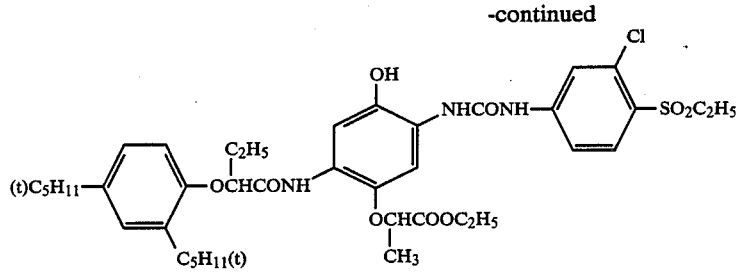

(A-26)

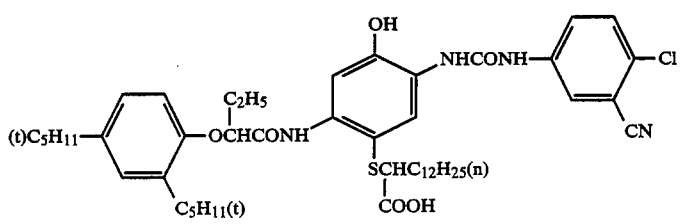

(A-28)

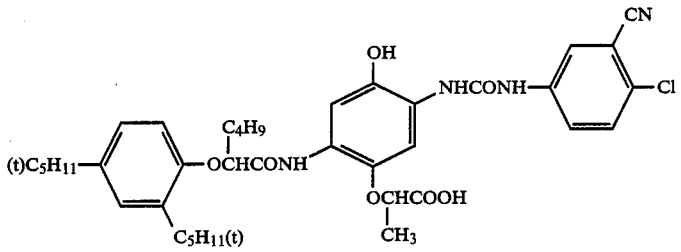

(A-27)

The cyan dye forming couplers represented by formula (A) can be synthesized by the methods described in U.S. Pat. Nos. 4,333,999 and 4,427,767, Japanese Patent Application (OPI) Nos. 204543/82, 204544/82, 204545/82, 198455/84, 35731/85, 37557/85, 42658/86 and 75351/86, these disclosures being incorporated herein by reference.

The cyan dye forming couplers represented by formula (A) is preferably incorporated into a redsensitive emulsion layer and the addition amount is preferably from $1\times10^5$ to $1\times10^{-3}$ mol per mol of silver in the layer.

The silver halide color photographic material of this invention is explained in further detail below.

For the silver halide emulsion layer(s) of the color photographic materials, any silver halide such as silver bromide, silver iodobromide, silver chlorobromide, silver chloroiodo-bromide, silver chloride, and silver chlorobromide may be used but silver iodobromide is particularly preferred. In the case of silver iodobromide, the content of silver iodide is usually less than about 40 mol %, preferably less than 20 mol %, and more preferably less than 10 mol %.

The silver halide grains may be so-called regular grains having a regular crystal form such as a cube, an octahedron, and a tetradecahedron, irregular grains having irregular crystal form such as a sphere, etc., crystal grains having a crystal defect, such as twin, etc., or a composite form of these. Also, a mixture of silver halide grains having various crystal forms can be used.

The silver halide emulsion for use in this invention may be a mono-dispersed emulsion having a narrow grain size distribution or a poly-dispersed emulsion having a broad grain size distribution.

Also, the silver halide emulsion for use in this invention may contain tabular silver halide grains having an aspect ratio of at least 5.

The silver halide grains of the aforesaid emulsion may have a uniform halogen composition throughout the entire grain or may have a different halogen composition between the internal portion and the outer layer portion, or may have a layer structure. These types of grains are disclosed in British Pat. No. 1,027,146, U.S. Pat. Nos. 3,505,068 and 4,444,877 and Japanese Patent Application (OPI) No. 143331/85. Also, silver halide grains each having a different composition may be joined to each other by epitaxial junction or silver halide grains may be joined to a compound other than silver halide, such as silver rhodanide, lead oxide, etc.

The aforesaid silver halide emulsion may be a surface latent image type emulsion forming latent images mainly in the surface thereof or an internal latent image type emulsion forming latent images in the interior of the grains, or may be an emulsion of the type forming latent images at the surface and in the interior thereof. Furthermore, the interior of the grains in the silver halide emulsion may be chemically sensitized.

The silver halide photographic emulsions for use in this invention can be produced by conventional methods as described in *Research Disclosure,* Vol. 176, No. 17643, pages 22 to 23 (December, 1978) ("I. Emulsion Preparation and Type") and ibid., Vol. 187, No. 18716, page 648 (November, 1979).

For the preparation of the photographic emulsion for use in this invention, various silver halide solvents (e.g., ammonia, potassium rhodanide) as well as thioethers and thion compounds described in U.S. Pat. No. 3,271,157 and Japanese Patent Application (OPI) Nos. 12360/76, 82408/78, 144319/78, 100717/79, and 155828/79, may be employed.

Also, a typical mono-dispersed silver halide emulsion contains silver halide grains having a mean grain size of at least about 0.1 micron, wherein at least 95% by weight thereof are within ±40% of the mean grain size. The mono-dispersed emulsion containing silver halide grains having a mean grain size of from 0.25 to 2 microns, wherein at least 95% by weight thereof or at least 95% by number thereof are within the range of ±20% of the mean grain size can be used in this invention.

During the formation or physical ripening of silver halide grains, a cadmium salt, a zinc salt, a lead salt, a thallium salt, an iridium salt or a complex salt thereof, a rhodium salt or a complex salt thereof, an iron salt or a complex salt thereof, etc., may be co-present in the system.

The silver halide emulsion for use in this invention is usually chemically and optically sensitized after physical ripening. Suitable additives for use in such a step are described in *Research Disclosure,* No. 17643 (December, 1978) and ibid., No. 18716 (November, 1979).

Other photographic additives which can be present in the photographic material of this invention are also described in these two *Research Disclosure* (RD) articles as follows:

| | Additive | RD 17643 | RD 18716 |
|---|---|---|---|
| 1. | Chemical Sensitizer | Page 23 | Page 648, right column |
| 2. | Sensitivity Increasing Agent | | " |
| 3. | Spectral Sensitizer, Super Color Sensitizer | Pages 23 to 24 | Page 648, right column to page 649, left column |
| 4. | Whitening Agent | Page 24 | |
| 5. | Antifoggant and Stabilizer | Pages 24 to 25 | Page 649, right column |
| 6. | Light Absorbent, Filter Dye | Pages 25 to 26 | Page 649, right column to page 650, left column |
| 7. | Stain Preventing Agent | Page 25, right column | Page 650, left to right column |
| 8. | Dye Image Stabilizer | Page 25 | |
| 9. | Hardening Agent | Page 26 | Page 651, left column |
| 10. | Binder | Page 26 | " |
| 11. | Plasticizer, Lubricant | Page 27 | Page 650, right column |
| 12. | Coating Aid, Surface Active Agent | Pages 26 to 27 | " |
| 13. | Antistatic Agent | Page 27 | " |

As spectral sensitizers which are used for the color photographic materials of this invention, the above known compounds can be used but in particular, the compounds represented by formulae (IV) or (V) described in Japanese Patent Application No. 313598/86 can be preferably used for processing of the photographic materials.

In addition to the cyan dye forming couplers represented by formula (A) described above, various color couplers can be used and specific examples of such couplers are described in *Research Disclosure,* No. 17643, VII-C to G.

As dye forming couplers, couplers giving the three primary colors of subtractive color photography (i.e., yellow, magenta and cyan) are important, and in addition to non-diffusible 4-equivalent or 2-equivalent couplers described in aforesaid *Research Disclosure,* No. 17643, VII-C and D, the following couplers can be preferably used in this invention.

Typical yellow couplers which can be used in this invention are oxygen atom releasing type yellow couplers or nitrogen atom releasing type yellow couplers. In these couplers, α-pivaloylacetanilide series couplers are excellent in fastness, in particular light-fastness, of colored dyes and on the other hand α-benzoylacetanilide series couplers give high color density.

Suitable magenta couplers which can be used in this invention include 5-pyrazolone series or pyrazoloazole series couplers having a ballast group and which are hydrophobic. The 5-pyrazolone series couplers, the 3-position of which is substituted by an arylamino group or an acylamino group, are preferred from the viewpoint of the hue and color density of the colored dyes.

Suitable cyan couplers which can be used in this invention include hydrophobic and non-diffusible naphtholic and phenolic couplers in addition to the above-described cyan dye forming coupler represented by formula (A). Typical examples of the preferred coupler are oxygen atom releasing type 2-equivalent naphtholic couplers. Also, couplers capable of forming cyan dyes having fastness to humidity and temperature are preferably used. Typical examples thereof are phenolic cyan couplers having an alkyl group of 2 or more carbon atoms at the meta-position of the phenol nucleus as described in U.S. Pat. No. 3,772,002, 2,5-diacylaminosubstituted phenolic couplers, phenolic couplers having a phenylureido group at the 2-position and an acylamino group at the 5-position thereof, and also 5-amidonaphthol series cyan couplers described in European Pat. No. 161,626A.

By using couplers giving a colored dye having proper diffusibility, the graininess of the color photographic material can be improved. As such couplers, specific examples of magenta couplers are described in U.S. Pat. No. 4,366,237 and specific examples of yellow, magenta, and cyan couplers are described in European Pat. No. 96,570.

The dye-forming couplers and aforesaid specific couplers may form dimers or higher polymers. Typical examples of polymerized dye forming couplers are described in U.S. Pat. No. 3,451,820. Specific examples of polymerized magenta couplers are described in U.S. Pat. No. 4,367,282.

Couplers releasing a photographically useful residue upon coupling can be also preferably used in this invention. As the DIR couplers releasing a development inhibitor, the couplers described in the patents cited in aforesaid *Research Disclosure,* No. 17643, VII-F are useful.

For the color photographic materials of this invention, couplers imagewise releasing a nucleating agent, a development accelerator or a precursor thereof at development can be used. Specific examples of this compound are described in British Pat. Nos. 2,091,140 and 2,131,188. Moreover, DIR redox compound releasing couplers described in Japanese Patent Application (OPI) No. 185950/85 and couplers releasing a dye recoloring after being released described in European Pat. No. 173,302 can be also used in this invention.

The couplers for use in this invention can be introduced into the color photographic materials by various known dispersion methods.

Examples of high-boiling point organic solvents which are used for an oil drop-in-water dispersion method are described in U.S. Pat. No. 2,322,027. Also, practical examples of the steps, effect, of latex dispersion methods and latexes for permeation are described in U.S. Pat. No. 4,199,363, and West German Patent Application (OLS) Nos. 2,541,274 and 2,541,230.

The color photographic materials of this invention may further contain hydroquinone derivatives, aminophenol derivatives, amines, gallic acid derivatives, catechol derivatives, ascorbic acid derivatives, non-coloring couplers, sulfonamidophenol derivatives, etc., as color fogging preventing agents or fading preventing agents.

For the color photographic materials of this invention, various fading preventing agents can be used. Examples of fading preventing agent are hydroquinones, 6-hydroxychromans, 5-hydroxychromans, spirochromans, p-alkoxyphenols, hindered phenols such as bisphenols, gallic acid derivatives, methylenedioxybenzenes, and the ether or ester derivatives obtained by silylating or alkylating the phenolic hydroxy group of the aforesaid compounds. Also, metal complexes such as (bissalicylaldoximato)nickel complex and (bis-N,N-dialkyldithiocarbamato)nickel complex.

For making the photographic light-sensitive material of this invention, the photographic emulsion layers and other layers are coated on a flexibile support usually used for photographic light-sensitive materials, such as plastic film.

For coating the photographic emulsion layers and other hydrophilic colloid layers, various coating methods such as a dip coating method, a roller coating method, a curtain coating method, an extrusion coating method, etc., can be utilized.

Various types of color photographic materials are within the scope of this invention. For example, general or cinematic color negative photographic films, color reversal photographic films for slide or television, color photographic papers, color positive films, and color reversal photographic papers are proper embodiments. The most preferred embodiments are a color nagative film and a color reversal film.

A color developer which is used for developing the color photographic materials of this invention may be an alkaline aqueous solution containing an aromatic primary amine color developing agent as the main component. As the color developing agent, an aminophenol series compound is useful but a p-phenylenediamine series compound is preferably used. Typical examples thereof are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, the sulfates, hydrochlorides, phosphates or p-toluenesulfonates of the aforesaid compounds, tetraphenylborates, and p-(t-octyl)benzenesulfonates.

These diamines are generally stable in a state of their salts as compared to their free states, and are preferably used in the form of a salt.

Examples of the aminophenol series derivatives as the color developing agent are o-aminophenol, p-aminophenol, 4-amino-2-methylphenol, 2-amino-3-methylphenol, and 2-oxy-3-amino-1,4-dimethylbenzene.

Other compounds described in L. F. A. Mason, *Photographic Processing Chemistry,* Focal Press, pages 226 to 229, U.S. Pat. Nos. 2,193,015 and 2,592,364, Japanese Patent Application (OPI) No. 64933/73 may be also used as the color developing agent.

If necessary, two or more kinds of color developing agents may be used as a combination thereof.

The color developer solution may further contain a pH buffer agent such as carbonates, borates or phosphates of an alkali metal; a development inhibitor or an antifoggant such as bromides, iodides, benzimidazoles, benzothiazoles, and mercapto compounds; a preservative such as hydroxylamine, triethanolamine, the compounds described in West German Patent Application (OLS) No. 2622950, sulfites, and hydrogensulfites; an organic solvent such as diethylene glycol; a development accelerator such as benzyl alcohol, polyethylene glycol, a quaternary ammonium salt, amines, thiocyanates, and 3,6-thiaoctane-1,8-diol; dye forming couplers; competing couplers; a nucleating agent such as sodium borohydride; an auxiliary developing agent such as 1-phenyl-3-pyrazolidone; a tackifier; an aminopolycarboxylic acid such as ethylenediaminetetraacetic acid, nitrilotriacetic acid, cyclohexanediaminetetraacetic acid, iminodiacetic acid, N-hydroxymethylethylenediaminetetraacetic acid, diethylenetriaminepentaacetic acid, triethylene-tetraminehexaacetic acid, and the compounds described in Japanese Patent Application (OPI) No. 195845/83; 1-hydroxyethylidene-1,1'-diphosphonic acid, organic phosphonic acids described in *Research Disclosure,* No. 18170 (May, 1979), aminophosphonic acids such as aminotris(methylenephosphonic acid), ethylenediamine-N,N,N',N'-tetramethylenephosphonic acid, etc., and phosphonocarboxylic acids described in *Research Disclosure,* No. 18170 (May, 1979).

The color developing agent is used in a concentration of from about 0.1 g to about 30 g, and preferably from about 1 g to about 15 g per liter of the color developer. Also, the pH of the color developer solution is generally higher than 7, and preferably from about 9 to 13.

The color photographic material of this invention is, after imagewise exposure, developed and then processed by a processing solution having a bleaching faculty.

A processing solution having bleaching faculty is a processing solution having the ability to convert metallic silver formed by the development reaction and colloidal silver contained in the photographic light-sensitive material into a soluble silver salt such as a silver thiosulfate complex salt, etc., or an insoluble silver salt such as silver bromide, etc., by oxidizing the silver, and examples thereof are a bleach solution and a bleach-fix (blix) solution. In this invention, it is preferred to process with a processing solution having a fixing faculty directly after color development.

Suitable bleaching agents which may be used for the processing solution having a bleaching faculty are oxidizing agents, for example, ferric complex salts such as ferrycyan ferric complex salts, citrate ferric complex salts, etc., persulfates, peroxides such as hydrogen peroxide, etc., but a preferred bleaching agent is an aminopolycarboxylic acid ferric complex salt, which is a complex salt of ferric ion and an aminopolycarboxylic acid or a salt thereof.

Specific examples of these aminopolycarboxylic acids and the salts thereof are as follows:

(1) Diethylenetriaminepentaacetic acid (2) Diethylenetriaminepentaacetic acid pentasodium salt
(3) Ethylenediamine-N-(β-oxyethyl)-N,N',N'-triacetic acid
(4) Ethylenediamine-N-(β-oxyethyl)-N,N',N'-triacetic acid trisodium salt
(5) Ethylenediamine-N-(β-oxyethyl)-N,N',N'-triacetic acid triammonium salt
(6) 1,2-Diaminopropanetetraacetic acid
(7) 1,2-Diaminopropanetetraacetic acid disodium salt
(8) Nitrilotriacetic acid
(9) Nitrilotriacetic acid sodium salt
(10) Cyclohexanediaminetetraacetic acid
(11) Cyclohexanediaminetetraacetic acid disodium salt
(12) N-Methyl-iminodiacetic acid
(13) Iminodiacetic acid
(14) Dihydroxyethylglycine
(15) Ethyl ether diaminetetraacetic acid
(16) Glycol ether diaminetetraacetic acid
(17) Ethylenediamine tetrapropionic acid
(18) 1,3-Diaminopropanetetraacetic acid
(19) Ethylenediaminetetraacetic acid.

However, the bleaching agent for use in this invention is not limited to the aforesaid compounds.

In the aforesaid compounds, compounds (1), (2), (6), (7), (10), (11), (12), (16) and (18) are particularly preferred.

The aminopolycarboxylic acid ferric complex salt may be used as the form of the complex salt but the ferric ion complex salt may be formed in an aqueous solution by adding a ferric salt such as ferric sulfate, ferric chloride, ferric sulfate, ferric ammonium sulfate, ferric phosphate, etc., and an aminopolycarboxylic acid to the aqueous solution. In the case of using as the form of the complex salt, the complex salts may be used singly or as a mixture thereof. On the other hand, in the case of forming a complex salt by using a ferric salt and an aminopolycarboxylic acid in an aqueous solution, ferric salts may be used singly or as a mixture thereof. Furthermore, aminopolycarboxylic acids may be used singly or as a mixture thereof. Also, in any cases, aminopolycarboxylic acid(s) may be used in an amount excessive to that of forming the ferric ion complex salt.

Also, a combination of an ethylenediaminetetraacetic acid Fe(III) complex salt and the aforesaid aminopolycarboxylic acid Fe(III) acid salt, excluding compound (19) described above, may be used.

Furthermore, the processing solution having a bleaching faculty containing the aforesaid ferric complex salt may further contain a complex of other metal ions than iron ion, such as cobalt ion, nickel ion, copper ion, etc.

The amount of the bleaching agent is from about 0.1 mol to about 1 mol, and preferably from 0.2 mol to 0.5 mol per liter of the processing solution having bleaching faculty. Also, the pH of the bleach solution is preferably from about 4.0 to about 8.0, and particularly preferably from 5.0 to 7.5.

The bleaching solution in this invention may further contain a re-halogenating agent such as potassium bromide, sodium bromide, ammonium chloride, potassium chloride, sodium chloride, ammonium chloride, etc. in addition to the aforesaid compound. The bleach solution may further contain other additives for ordinary bleach or blix solutions, e.g., one or more inorganic or organic acid or the salts thereof having a pH buffer faculty, such as sodium nitrate, ammonium nitrate, boric acid, borax, sodium metaborate, acetic acid, sodium acetate, sodium carbonate, potassium carbonate, phosphorous acid, phosphoric acid, sodium phosphate, citric acid, sodium citrate, tartaric acid, and the salts thereof.

In this invention, a fix solution or a blix solution, used subsequent to processing with the bleach solution, can contain a thiosulfate such as sodium thiosulfate, ammonium thiosulfate, ammoniumsodium thiosulfate, potassium thiosulfate, etc., a thiocyanate such as ammonium thiocyanate, potassium thiocyanate, etc., thiourea, thioether, etc., as a fixing agent. The addition amount of the fixing agent is preferably less than about 3 mol %, and particularly preferably less than 2 mol % per liter of the processing solution having a fixing faculty or blixing faculty.

The processing solution having bleaching faculty can further contain a sulfite releasing compound, e.g., sulfites such as sodium sulfite, ammonium sulfite, etc., hydrogensulfites, and addition products of aldehyde and hydrogensulfide, such as carbonyl hydrogensulfide, etc.

Furthermore, the blix solution may contain an aminopolycarbonate as represented by formula (1) to (19) described above or an organic sulfonic acid compound such as ethylenediaminetetrabismethylenesulfonic acid, diethylenetriaminepentabismethylenesulfonic acid, 1,3-diaminopropanetetrabismethylenephosphonic acid, nitrilo-N,N,N-trimethylenephosphonic acid, 1-hydroxyethylidene-1,1-diphosphonic acid, etc.

In this invention, the processing solution having bleaching faculty may contain a bleach accelerator such as a compound having a mercapto group or a disulfide bond, an isothiourea derivative, and a thiazoline derivative. The content of such a compound is preferably from $1\times10^{-5}$ to $1\times10^{1}$ mol, and particularly preferably from $1\times10^{-4}$ to $5\times10^{-2}$ mol per liter of the processing solution having bleaching faculty.

A bleach accelerator can be used in the processing solution having bleach faculty in this invention, and may be selected from compounds having bleach accelerating effect such as a compound having a mercapto group or a disulfide bond, a thiazolidine derivative, a thiourea derivative, and an isothio derivative, and specific examples are the compounds described in Japanese Patent Application No. 313598/86 by general formulae.

The aforesaid compounds are added to the processing solution as a solution in water, an alkaline organic acid, an organic solvent, etc., and the compound may be directly added to the processing solution as a powder without giving any undesirable influences on the bleach acceleration effect.

Furthermore, in this invention, a bleach accelerator may be present in the color photographic material. In this case, the bleach accelerator may be present in one or more emulsion layers such as blue-sensitive emulsion layer(s), green-sensitive emulsion layer(s), and red-sensitive emulsion layer(s) or other hydrophilic colloid layer(s) such as protective layer(s), interlayer(s), and a subbing layer.

The fixing step or blix step in this invention may be performed by using a single tank, but may also be performed by using two or more tanks and in the latter case, a replenisher for the fix solution or blix solution may be supplied in a multistage countercurrent system. Also, in the case of employing multiple tanks, the processing solution may be circulated alternately through the tanks to form a uniform processing solution as a whole and a replenisher may be supplied to one of these tanks.

The silver halide color photographic material of this invention is, after desilvering such as fixing or blixing, generally washed and/or stabilized.

The amount of wash water for the wash step can be selected in a wide range according to the characteristics (e.g., elements such as couplers, etc.) and the use of the color photographic material, as well as the temperature of wash water, the number (stage number) of wash tanks, the replenishing system (countercurrent system or normal current system), and other various conditions. In these cases, the relation between the number of wash tanks and the amount of wash water in the multistage countercurrent system is obtained by the method described in *Journal of the Society of Motion Picture and Television Engineers*, Vol. 64, pp. 248 to 253 (May 1955).

In the multistage countercurrent system described in the aforesaid technical journal, the amount of wash water can be greatly reduced but there occur such problems that bacteria may proliferate due to the increase of the residence time in the tanks and floating debris may attach to color photographic materials. In processing for the color photographic light-sensitive materials of this invention, a method of reducing calcium and magnesium described in Japanese Patent Application (OPI) No. 288838/87 can be very effectively used. Also, isothiazolone compounds or thiabendazoles described in Japanese Patent Application (OPI) No. 8542/82, chlorine series sterilizers such as chlorinated sodium isocyanurate, etc., and also benzotriazoles, and the sterilizers described in Hiroshi Horiguchi *Sakkin Bobai Zai no Kagaku* (*Chemistry of Antibacterial and Antifungal Agents*) (1982), *Biseibutsu no Sakkin. Sakkin Bobai Gijutsu* (*Sterilization of Miroorganisms and Sterilizing Antifungal Techniques*), edited by Eisei Gijutsu Kai (1982), and *Bokin Bobai Zai Jiten* (*Handbook of Antibacterial and Antifungal Agents*), edited by Antibacterial and Antifungal Society of Japan (1986).

The pH of the wash water in processing of the color photographic material of this invention is from about 4 to about 9, preferably from 5 to 8. The temperature of wash water and washing time can be desirably selected according to the characteristics, uses, etc., of the color photographic material and are generally from 20 seconds to 10 minutes at from 15° C. to 45° C., and preferably from 30 seconds to 5 minutes at from 25° C. to 40° C.

In processing of the color photographic materials of this invention, a stabilization step can be directly used in place of washing. For such stabilization processes, the processes described in Japanese Patent Application (OPI) Nos. 8543/82, 14834/83, 184343/84, 220345/85, 238832/85, 239784/85, 239749/85, 4054/86, and 118749/86 can be employed. In particular, a stabilization solution containing 1-hydroxyethylidene-1,1-diphosphonic acid, 5-chloro-2-methyl-4-isothiazolin-3-one, a bismuth compound, an ammonium compound, etc., is preferably used.

Also, in some case, the stabilization process is performed after aforesaid wash process and as an example, there is a stabilization bath containing formalin and a surface active agent, which is used as the final bath for processing camera film type color photographic materials.

The following examples are intended to illustrate the present invention but not to limit it in any manner. Unless otherwise indicated, all parts, percents, ratios and the like are by weight.

EXAMPLE 1

A multilayer color photographic material (Sample 101) having the layers of the following compositions on a triacetyl cellulose film support having a gelatin subbing layer was prepared.

In the following compositions, the coating amount of silver halide and colloidal silver is shown by g/m$^2$ as silver, the coating amount of coupler, other additives and gelatin is by g/m$^2$, and the amount of sensitizing dye is by a mol number per mol of silver halide in the same emulsion layer.

| | |
|---|---|
| Layer 1 (Antihalation Layer) | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Layer 2 (Interlayer) | |
| Fine Grain Silver Bromide (Mean grain size 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Layer 3 (1st Red-Sensitive Emulsion Layer) | |
| Silver Iodobromide Emulsion (AgI 12 mol %, internal high-AgI type, sphere-corresponding diameter 0.3 μm, variation coeff. of sphere-corresponding diameter 29%, mixture of normal crystal and twin grains, aspect ratio 2.5) | 0.4 |
| Gelatin | 0.6 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.06 |
| ExC-4 | 0.04 |
| ExC-7 | 0.04 |
| ExC-2 | 0.03 |
| Solv-1 | 0.03 |
| Solv-2 | 0.012 |
| Layer 4 (2nd Red-Sensitive Emulsion Layer) | |
| Silver Iodobromide Emulsion (AgI 15 mol %, internal high-AgI type, sphere-corresponding diameter 0.7 μm, variation coeff. of sphere-corresponding diameter 25%, mixture of normal crystal and twin grains, aspect ratio 4) | 0.7 |
| Gelatin | 0.5 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-2 | 0.02 |
| Layer 5 (3rd Red-Sensitive Emulsion Layer) | |
| Silver Iodobromide Emulsion (AgI 10 mol %, internal high-AgI type, sphere-corresponding diameter 0.8 μm, variation coeff. of sphere-corresponding diameter 16%, mixture of normal crystal and twin grains, aspect ratio 1.3) | 1.0 |
| Gelatin | 1.0 |
| ExS-1 | $1.0 \times 10^{-4}$ |
| ExS-2 | $3.0 \times 10^{-4}$ |
| ExS-3 | $1.0 \times 10^{-5}$ |
| ExC-6 | 0.13 |
| Solv-1 | 0.01 |
| Solv-2 | 0.05 |

-continued

| | |
|---|---|
| Layer 6 (Interlayer) | |
| Gelatin | 1.0 |
| Cpd-1 | 0.03 |
| Solv-1 | 0.05 |
| Layer 7 (1st Green-Sensitive Emulsion Layer) | |
| Silver Iodobromide Emulsion (AgI 12 mol %, internal high-AgI type, sphere-corresponding diameter 0.3 μm, variation coeff. of sphere-corresponding diameters 8%, mixture of normal crystal and twin grains, aspect ratio 2.5) | 0.30 |
| ExS-4 | $5.0 \times 10^{-4}$ |
| ExS-6 | $0.3 \times 10^{-4}$ |
| ExS-5 | $2.0 \times 10^{-4}$ |
| Gelatin | 1.0 |
| ExM-9 | 0.2 |
| ExY-14 | 0.03 |
| ExM-8 | 0.03 |
| Solv-1 | 0.5 |
| Layer 8 (2nd Green-Sensitive Emulsion Layer) | |
| Silver Iodobromide Emulsion (AgI 14 mol %, internal high-AgI type, sphere-corresponding diameter 0.6 μm, variation coeff. of sphere-corresponding diameter 38%, mixture of normal crystal and twin grains, aspect ratio 4) | 0.4 |
| Gelatin | 0.5 |
| ExS-4 | $5.0 \times 10^{-4}$ |
| ExS-5 | $2.0 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| Layer 9 (3rd Green-Sensitive Emulsion Layer | |
| Silver Iodobromide Emulsion (AgI 16 mol %, internal high-AgI type, sphere-corresponding diameter 1.0 μm, variation coeff. of sphere-corresponding diameter 80%, mixture of normal crystal and twin grains, aspect ratio 1.2) | 0.85 |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-12 | 0.20 |
| ExM-8 | 0.02 |
| ExY-15 | 0.02 |

-continued

| | |
|---|---|
| Solv-1 | 0.20 |
| Solv-2 | 0.05 |
| Layer 10 (Yellow Filter Layer) | |
| Gelatin | 1.2 |
| Yellow Colloidal Silver | 0.08 |
| Cpd-2 | 0.1 |
| Solv-1 | 0.3 |
| Layer 11 (1st Blue-Sensitive Emulsion Layer) | |
| Silver Iodobromide Emulsion (AgI 14 mol %, internal high-AgI type, sphere-corresponding diameter 0.5 μm, variation coeff. of sphere-corresponding diameters 15%, octahedral grains) | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| Layer 12 (2nd Blue-Sensitive Emulsion Layer) | |
| Silver Iodobromide Emulsion (AgI 10 mol %, internal high-AgI type, sphere-corresponding diameter 1.3 μm, variation coeff. of sphere-corresponding diameter 25%, mixture of normal crystal and twin grains, aspect ratio 4.5) | 0.5 |
| Gelatin | 0.6 |
| ExS-9 | $1 \times 10^{-4}$ |
| ExY-16 | 0.25 |
| Solv-1 | 0.07 |
| Layer 13 (1st Protective Layer) | |
| Gelatin | 0.8 |
| UV-1 | 0.1 |
| UV-2 | 0.2 |
| Solv-1 | 0.01 |
| Solv-2 | 0.01 |
| Layer 14 (2nd Protective Layer) | |
| Fine Grain Silver Bromide (mean grain size 0.07 μm) | 0.5 |
| Gelatin | 0.45 |
| Polymethyl Methacrylate Particles (mean diameter 1.5 m) | 0.2 |
| H-1 | 0.4 |
| Cpd-3 | 0.5 |
| Cpd-4 | 0.5 |

Each layer further contained a surface active agent as a coating aid. Thus, Sample 101 was prepared.

The chemical structures or names of the compounds used above abbreviated are shown below:

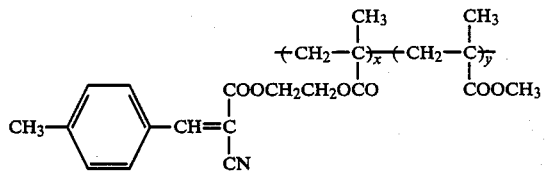

UV-1 x/y = 7/3 (weight ratio)

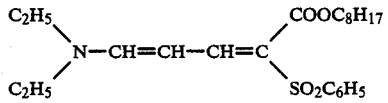

UV-2

| | |
|---|---|
| Tricresyl phosphate | Solv-1 |
| Dibutyl phthalate | Solv-2 |
| Bis(2-ethylhexyl)phthalate | Solv-3 |

-continued
ExM-8
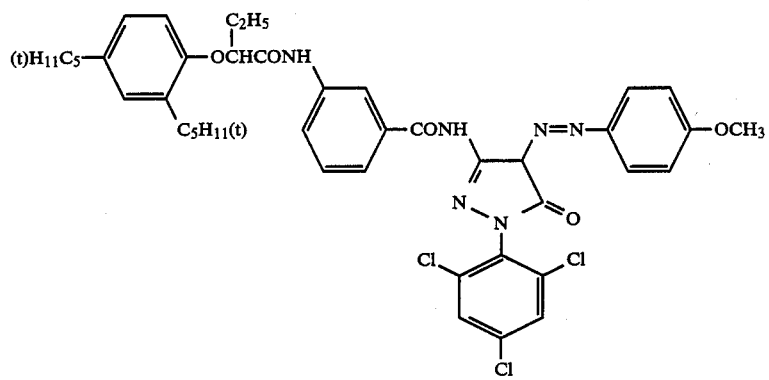
ExF-1
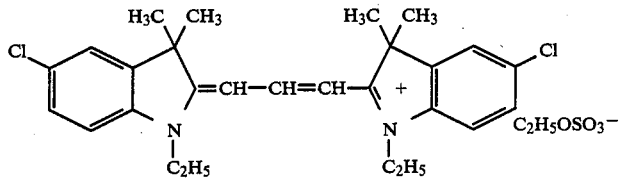
ExC-2
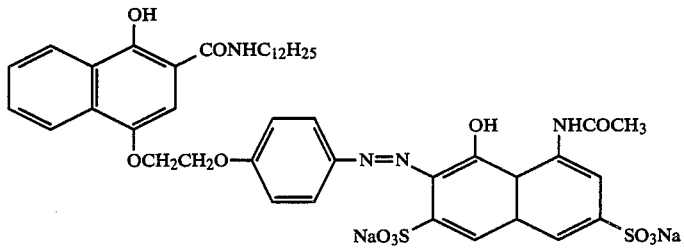
ExC-3
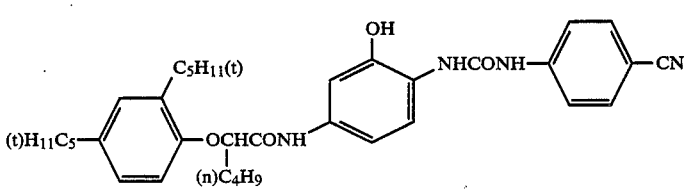
ExC-4
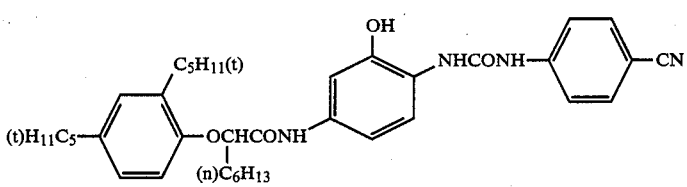
ExY-14
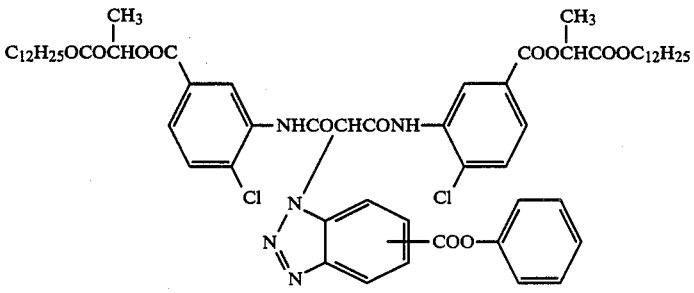

-continued
ExY-15
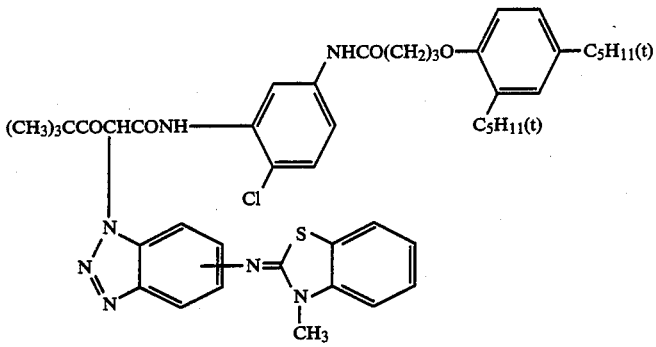
ExC-6
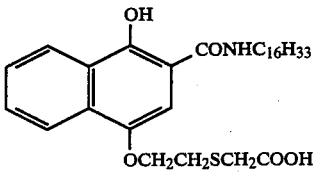
ExC-7
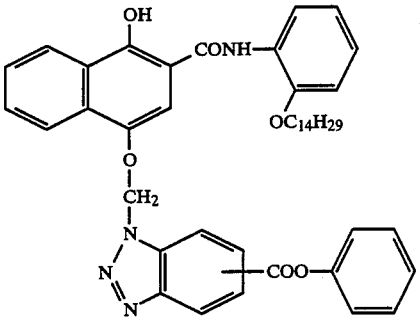
ExM-9
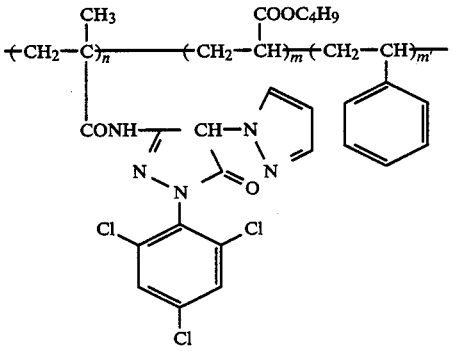
n = 50
m = 25
m' = 25
mol. wt. about 20,000
ExM-10
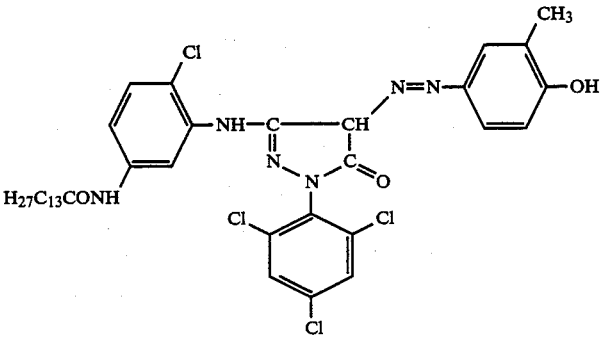

-continued
ExM-11
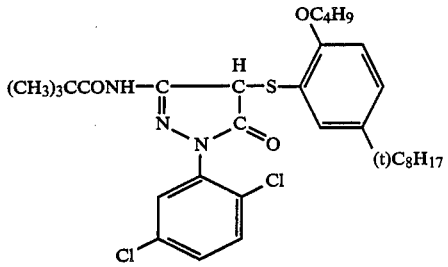
ExM-12
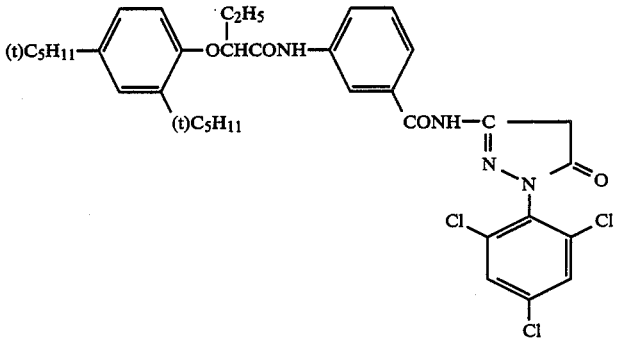
ExM-13
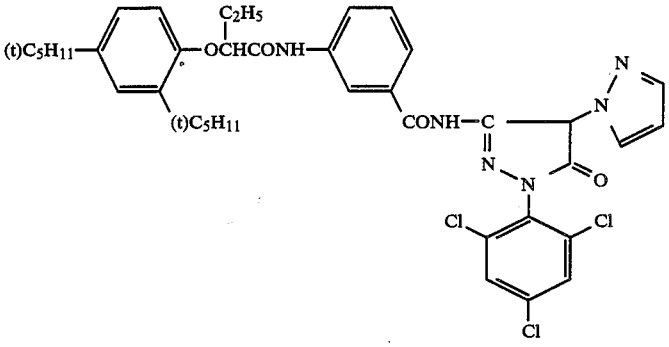
ExY-16
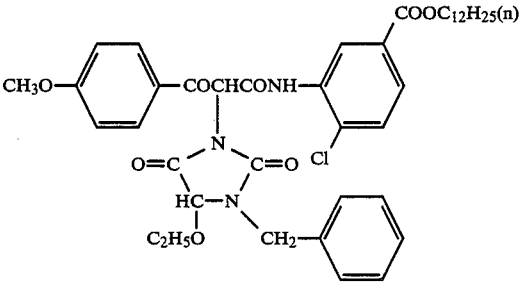
Cpd-1
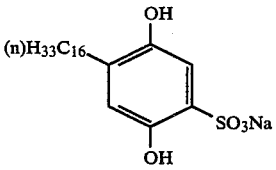
Cpd-2
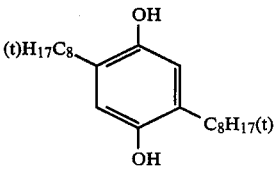

-continued
ExS-1
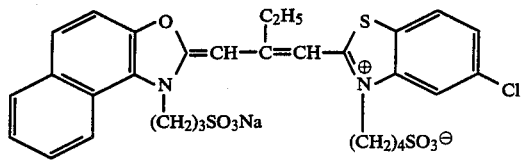
ExS-2
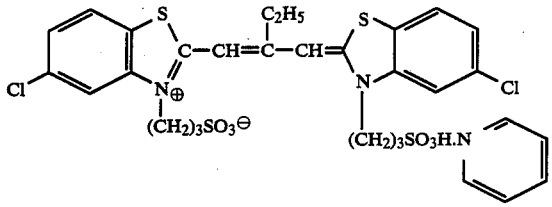
ExS-3
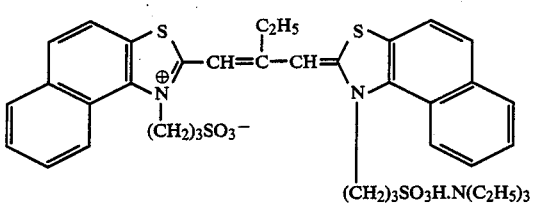
ExS-4
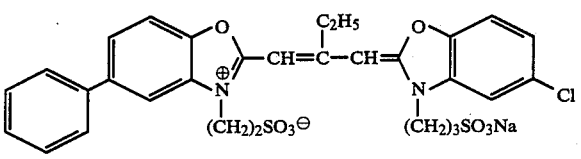
ExS-5
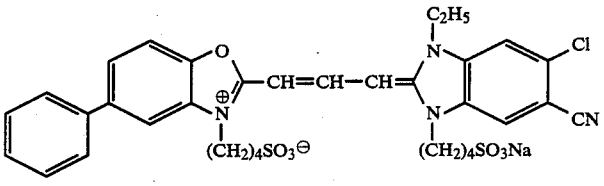
Exs-6
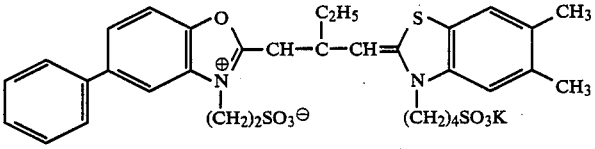
ExS-7
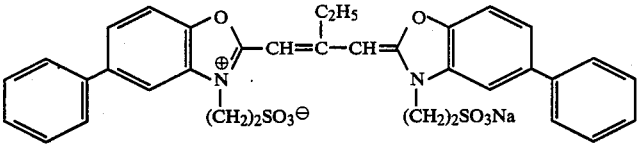
ExS-8
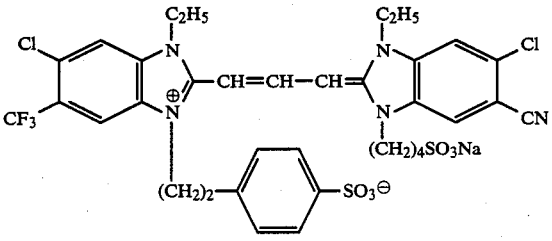

-continued

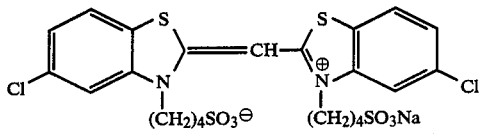

ExS-9

$CH_2{=}CH{-}SO_2{-}CH_2{-}CONH{-}CH_2$
$CH_2{=}CH{-}SO_2{-}CH_2{-}CONH{-}CH_2$

H-1

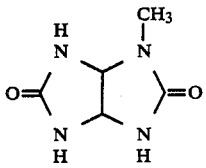

Cpd-3

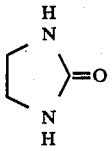

Cpd-4

PREPARATION OF SAMPLES 102 TO 110

By following the same procedure as above for preparing Sample 101, except that the couplers shown in Table 1 below were used in place of the couplers, ExC-3 and ExC-4 in Layers 3 and 4 and the coupler, ExC-6 in Layer 5 in equimolar amounts, Samples 102 to 110 were prepared.

Each of the samples obtained was cut to 35 mm in width, used for photographing a standard subject, and then a running test of 500 meters of each sample was carried out through the following processing step (I) or (II).

After finishing the running test, each of Samples 101 to 110 was subjected to wedge exposure of 20 CMS by. white light and subjected to Processing (I) or (II) shown below. Thereafter, the amount of silver remaining in each sample was measured by a fluorescent X-ray technique. Furthermore, the spectral absorption of the color images was measured using a spectrophotometer, Type U-3200, trade name, made by Hitachi, Ltd., and the difference between Dmax at density 1.0 and $D_{max}$ at density 0.25 was determined. The results thereof are shown in Table 1 below.

| Processing Step (I) | | |
|---|---|---|
| | (38° C.) Processing (I) | |
| Step | Time | Amount* |
| Color development | 3 min. 15 sec. | 15 ml |
| Bleach | 3 min. 00 sec. | 5 ml |
| Fix | 4 min. 00 sec. | 30 ml |
| Stabilization (1) | 30 sec. | — |
| Stabilization (2) | 30 sec. | — |
| Stabilization (3) | 30 sec. | 30 ml |
| Drying | 1 min. 30 sec. at 50° C. | — |

*:Per 35 mm × 1 meter

In the aforesaid processing step, the stabilizations (1), (2), and (3) were perfomed by a countercurrent system of (3)→(2)→(1). Also, the amount of fix solution carried in the wash tank was 2 ml per meter.

The composition of the processing solutions used in the processing step (I) were as follows.

| | Mother Liquor (grams) | Replenisher (grams) |
|---|---|---|
| Color Developer | | |
| Diethylenetriaminetetra-acetic Acid | 1.0 | 2.0 |
| 1-Hydroxyethylidene-1,1-diphosphonic Acid | 2.0 | 3.3 |
| Sodium Sulfite | 4.0 | 5.0 |
| Potassium Carbonate | 30.0 | 38.0 |
| Potassium Bromide | 1.4 | — |
| Potassium Iodide | 1.3 mg | — |
| Hydroxylamine | 2.4 | 3.2 |
| 4-(N—Ethyl-N—β-hydroxyethyl-amino)-2-methylaniline Sulfate | 4.5 | 7.2 |
| Water to make | 1 liter | 1 liter |
| pH | 10.00 | 10.05 |
| Bleach Solution | | |
| Ethylenediaminetetraacetic Acid Ferric Ammonium salt | 50 | 60 |
| 1,3-Diaminopropanetetra-acetic Acid Ferric Ammonium Salt | 60 | 72 |
| Aqueous Ammonia | 7 ml | 5 ml |
| Ammonium Nitrate | 10.0 | 12.0 |
| Ammonium Bromide | 150 | 170 |
| Water to make | 1 liter | 1liter |
| pH | 6.0 | 5.8 |
| Fix Solution | | |
| Ethylenediaminetetraacetic Acid Disodium salt | 1.0 | 1.2 |
| Sodium Sulfite | 4.0 | 5.0 |
| Sodium Hydrogensulfite | 4.6 | 5.8 |
| Ammonium Thiosulfate (70% aq. solution) | 175 ml | 200 ml |
| Water to make | 1 liter | 1 liter |
| pH | 6.6 | 6.6 |
| Stablization Solution | | |
| Formaline (37% w/v) | 2.0 ml | 3.0 ml |
| Polyoxyethylene-p-mono-nonyl Phenyl Ether (mean polymerization degree 10) | 0.3 | 0.45 |
| 5-Chloro-2-methyl-4-iso thiazolin-3-one | 0.03 | 0.045 |
| Water to make | 1 liter | 1 liter |

Processing Step (II) (38°)

Tank

-continued

| Step | Time | Volume | Replenisher* |
|---|---|---|---|
| Color Development | 3 min. 15 sec. | 8 liters | 15 ml |
| Blix | 2 min. 30 sec. | 8 liters | 25 ml |
| Wash (1) | 20 sec. | 4 liters | — |
| Wash (2) | 20 sec. | 4 liters | — |
| Wash (3) | 20 sec. | 4 liters | 10 ml |
| Stabilization | 20 sec. | 4 liters | 10 ml |

*: The amount per 35 mm × 1 meter of the sample.

In the aforesaid processing step (II), Wash (1), (2) and (3) was carried out by a countercurrent system of (3)→(2)→(I).

The compositions of the processing solutions used in the aforesaid processing step (II) were as follows.

| | Mother Liquor (grams) | Replenisher (grams) |
|---|---|---|
| Color Developer | | |
| Diethylenetriaminepenta-acetic Acid | 1.0 | 1.0 |
| 1-Hydroxyethylidene-1,1-diphosphonic Acid | 2.0 | 2.4 |
| Sodium Sulfite | 2.0 | 4.8 |
| Potassium Carbonate | 35.0 | 45.0 |
| Potassium Bromide | 1.6 | — |
| Potassium Iodide | 2.0 mg | — |
| Hydroxylamine | 2.0 | 3.6 |
| 4-(N—Ethyl-N—β-hydroxyethyl-amino)-2-methylaniline Sulfate | 5.0 | 7.5 |
| Water to make | 1 liter | 1 liter |
| pH (with potassium hydroxide) | 10.20 | 10.35 |
| Blix Solution | | |
| Ethylenediaminetetraacetic Acid Ferric Ammonium salt | 40 | 45 |
| Diethylenetriaminepenta-acetic Acid Ferric Ammonium Salt | 40 | 45 |
| Ethylenediaminetetraacetic Acid Disodium Salt | 10 | 10 |
| Sodium Sulfite | 15 | 20 |
| Aq. Soln. of Ammonium Thio-sulfite (70% w/v) | 240 | 270 |
| Aqueous Ammonia (26%) | 14 ml | 12 ml |
| Water to make | 1 liter | 1 liter |
| pH | 6.7 | 6.5 |

Wash Water

The following three kinds of solutions were used.

(1) City Water

Calcium: 26 mg/liter

Magnesium: 9 mg/liter (sic)

pH: 7.2

(2) Ion Exchanged Water

City water as shown above was treated by a strong cation exchange resin (Na-form) made by Mitsubishi Chemical Industries Ltd. to reduce the impurity ions to the following levels.

Calcium: 1.1 mg/liter

Magnesium 0.5 mg/liter pH: 6.6

(3) City water containing a chelating agent.

To the city water described above (1) was added 500 mg/liter of ethylenediaminetetraacetic acid disodium salt as a chelating agent. The pH thereof was 6.7.

The results obtained are shown in Table 1 below.

In addition, the comparison compound (c) used for Comparison Samples 103 and 104 is shown below:

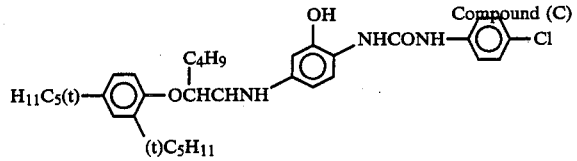

TABLE 1

| Sample No. | Coupler in Layers 3,4 | Coupler in Layer 5 | Processing Step | Amount of Ag (mg/m²) | Δλ |
|---|---|---|---|---|---|
| 101 (Comparison) | ExC-3 | ExC-6 | (I) | 45 | 1 |
| | | | (II) | 65 | — |
| 102 (Comparison) | ExC-3 | (37) | (I) | 18 | 12 |
| | | | (II) | 23 | — |
| 103 (Comparison) | Coupler (C) | (37) | (I) | 19 | 10 |
| | | | (II) | 25 | — |
| 104 (Comparison) | Coupler (C) | (2) | (I) | 10 | 11 |
| | | | (II) | 19 | — |
| 105 (Invention) | A-3 | (37) | (I) | 8 | 4 |
| | | | (II) | 17 | — |
| 106 (Invention) | A-5 | (37) | (I) | 9 | 5 |
| | | | (II) | 15 | — |
| 107 (Invention) | A-7 | (7) | (I) | 10 | 6 |
| | | | (II) | 18 | — |
| 108 (Invention) | A-3 | (7) | (I) | 8 | 3 |
| | | | (II) | 16 | — |
| 109 (Invention) | A-3 | (15) | (I) | 9 | 4 |
| | | | (II) | 18 | — |
| 110 (Invention) | A-5 | (15) | (I) | 9 | 5 |
| | | | (II) | 16 | — |

As is clear from the results shown in Table 1 above, it can be seen that the samples of this invention give less residual silver amount, show less Δλ, and are excellent in color balance.

Furthermore, when each of Samples 101 to 110 was wedge-exposed, stored for 3 days under conditions of 45° C. and 80% in relative humidity, and the reduction in sensitivity was determined, it was confirmed that Samples 105 to 110 of this invention showed clearly less reduction in sensitivity and were excellent in storage stability of latent images as compared to Comparison Samples 101 to 104.

Then, 20% by volume of an EDTA iron (II) salt-containing blix solution obtained by adding steel wool to the blix solution followed by sufficient reduction was added to an ordinary blix solution and after adjusting the pH thereof to 6.0, the samples were processed using the blix solution. The results showed that the reductions in density of Samples 101 to 108 at $D_{max}$ portion were 0.2, while the reduction in density of Samples 109 to 110 was 0.03.

As described above, the color photographic materials of this invention are excellent in quickness of desilvering as well as in recoloring property and color balance.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having on a support at least one silver halide emulsion layer, wherein said color photographic material contains at least one compound releasing a bleach accelerator upon reaction with the oxidation product of an aromatic primary amine color developing agent and at least one cyan dy -forming coupler represented by formula (A);

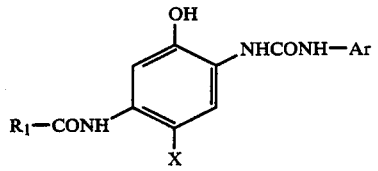

(A)

wherein $R_1$ represents a substituted or unsubstituted aliphatic group, a substituted or unsubstituted aromatic group, or a substituted or unsubstituted heterocyclic group; X represents a hydrogen atom or a group capable of releasing upon a coupling reaction with the oxidation product of an aromatic primary amine color developing agent; and Ar represents an aromatic group having at least one substituent, wherein the sum of the $\sigma_m$ and $\sigma_p$ values of said substituent is at least 0.67.

2. The silver halide color photographic material as claimed in claim 1, wherein said compound releasing a bleach accelerator is represented by formula (I):

$$A-(L)_p-Z \quad (I)$$

wherein A represents a group releasing from $(L)_p$—Z reaction with the oxidation product of a color developing agent; L represents a timing group or a group releasing from Z upon reaction with the oxidation product of a color developing agent; p represents an integer of from 0 to 3; when p is plural, the Ls may be the same or different; and Z represents a group having a bleach acceleration effect when the A—$(L)_p$ bond is cleaved.

3. The silver halide color photographic material as claimed in claim 2, wherein the compound releasing a bleach accelerator represented by formula (I) is a compound represented by formula (II) to (VI):

$$A-(L_1)_a-S-\underbrace{R_{31}-X_1-R_{32}}_{(Z)_b} \quad (II)$$

$$A-(L_1)_a-S-\underbrace{(R_{31}-X_2)_l-R_{32}}_{(Z)_b} \quad (III)$$

$$A-(L_1)_a-S-\underbrace{\{R_{31}-(X_2)_m\}_r-R_{33}}_{(Z)_u} \quad (IV)$$

$$A-(L_1)_a-S-R_{31}-(Z)_t \quad (V)$$

$$A-L_2-S-\underbrace{\{R_{31}-(X_2)_m\}_r-R_{34}}_{(Z)_b} \quad (VI)$$

wherein A represents a coupler residue or an oxidation-reduction group; $L_1$ represents a timing group; $L_2$ represents a group becoming a coupler residue after cleaving from A or a group becoming an oxidation-reduction group after cleaving from A; $R_{31}$ and $R_{32}$, which may be the same or different, each represents a substituted or unsubstituted aliphatic group having from 1 to 6 carbon atoms or a substituted or unsubstituted aromatic group having from 6 to 10 carbon atoms; $R_{33}$ represents a 3- to 7-membered carbon ring group or a 3- to 7-membered substituted or unsubstituted heterocyclic group having less than 4 nitrogen atoms as the ring-constituting atoms; $R_{34}$ is the same as defined for said $R_3$l or represents a 3- to 7-membered substituted or unsubstituted heterocyclic group; $X_1$ represents —S—, —COO—, $$-\underset{\underset{R_{35}}{|}}{N}CO-,\ -\underset{\underset{R_{35}}{|}}{N}SO_2-,\ -\underset{\underset{R_{35}}{|}}{N}-,$$

—CO—, —$SO_2$—, or —$SO_2O$—; $X_2$ is the same as defined for said $X_1$ or represents —O—; Z represents a carboxy group, a sulfo group, a hydroxy group or $$-N\begin{matrix}R_{35}\\R_{36}\end{matrix};$$

$R_{35}$ and $R_{36}$, which may be the same or different, each represents a hydrogen atom or a substituted or unsubstituted aliphatic group having from 1 to 3 carbon atoms; a represents 0 or 1; b represents an integer of from 1 to 3, when b is plural, plural Zs may be the same or different; l represents 2 or 3, and said plural $(R_{31}—X_2)_s$ may be the same or different; represents 0 or 1; r represents an integer of from 0 to 3, when r is plural, said plural $\{R_{31}—(X_2)_m\}$s may be the same or different; u represents an integer of from 0 to 3; when $R_{33}$ is a carbon ring, u is 1 or more and when u is plural, said plural Zs may be the same or different; and t represents 2 or 3 and said plural Zs may be said same or different.

4. The silver halide color photographic material as claimed in claim 3, wherein said compound represented by formula (II) to (VI) is a bis-compound, a telomer or a polymer.

5. The silver halide color photographic material as claimed in claim 1, wherein said compound releasing a bleach accelerator is present in an amount of from about $1\times10^{-7}$ mol to about $1\times10^{-1}$ mol per square meter of the material.

6. The silver halide color photographic material as claimed in claim 5, wherein said amount is from $1\times10^{-6}$ mol to $5\times10^{-2}$ mol per square meter.

7. The silver halide color photographic material as claimed in claim 1, wherein said $R_1$ represents an aliphatic group having from 1 to 36 carbon atoms including a straight chain, branched or cyclic alkyl group, alkenyl group, or alkynyl group, a substituted or unsubstituted aryl group having from 6 to 36 carbon atoms which may be a condensed ring, or a monocyclic or condensed heterocyclic group having from 2 to 36 carbon atoms.

8. The silver halide color photographic material as claimed in claim 1, wherein said group represented by X capable of releasing upon a coupling reaction is a halogen atom, —$OR_5$, —$SR_5$, $$-\underset{\underset{O}{\|}}{O}CR_5,\ -\underset{\underset{O}{\|}}{N}HCOR_5,$$

-continued $$-NHCSR_5,\ -\underset{\underset{O}{\|}}{C}-OR_5,\ -\underset{\underset{O}{\|}}{C}NHR_5,$$

an aromatic azo group having from 6 to 30 carbon atoms, or a heterocyclic group having from 1 to 30 carbon atoms and bonding to the coupling active position to a nitrogen atom thereof, wherein $R_5$ represents an aliphatic group having from 1 to 30 carbon atoms, an aromatic group having from 6 to 30 carbon atoms or a heterocyclic group having from 2 to 30 carbon atoms.

9. The silver halide color photographic material as claimed in claim 1, wherein said Ar is a substituted aryl group which may be a condensed ring having from 1 to 5 substituents.

10. The silver halide color photographic material as claimed in claim 1, wherein said sum of the $\sigma_m$ and $\sigma_p$ values is 0.70.

11. The silver halide color photographic material as claimed in claim 10, wherein said sum of the $\sigma_m$ and $\sigma_p$ values is 0.75.

12. The silver halide color photographic material as claimed in claim 1, wherein said coupler represented by formula (A) forms a dimer, an oligomer or a higher polymer bonded through a divalent or higher group at $R_1$, Ar or X.

13. The silver halide color photographic material as claimed in claim 1, wherein the compound releasing a bleach accelerator represented by formula (I) is a compound represented by formula (II):

$$A-(L_1)_a-S-\underbrace{R_{31}-X_1-R_{32}}_{(Z)_b} \qquad \text{(II)}$$

wherein

A represents a coupler residue or an oxidation-reduction group;

$L_1$ represents a timing group;

$R_{31}$ and $R_{32}$, which may be the same or different, each represents a substituted or unsubstituted aliphatic group having from 1 to 6 carbon atoms or a substituted or unsubstituted aromatic group having from 6 to 10 carbon atoms;

$X_1$ represents —S—, —COO—, $$-\underset{\underset{R_{35}}{|}}{N}CO-,\ -\underset{\underset{R_{35}}{|}}{N}SO_2-,\ -\underset{\underset{R_{35}}{|}}{N}-,$$

—CO—, $-SO_2-$, or $-SO_2O-$;

Z represents a carboxy group, a sulfo group, a hydroxy group or $$-N\begin{matrix}R_{35}\\R_{36}\end{matrix};$$

$R_{35}$ and $R_{36}$, which may be the same or different, each represents a hydrogen atom or a substituted or unsubstituted aliphatic group having from 1 to 3 carbon atoms;

a represents 0 or 1; and b represents an integer of from 1 to 3, and when b is plural, said Zs may be the same or different.

14. The silver halide color photographic material as claimed in claim 1, wherein the compound releasing a bleach accelerator represented by formula (I) is a compound represented by formula (III):

$$A-(L_1)_a-S-\underbrace{(R_{31}-X_2)_l-R_{32}}_{(Z)_b} \qquad \text{(III)}$$

wherein

A represents a coupler residue or an oxidation-reduction group;

$L_1$ represents a timing group;

$R_{31}$ and $R_{32}$, which may be the same or different, each represents a substituted or unsubstituted aliphatic group having from 1 to 6 carbon atoms or a substituted or unsubstituted aromatic group having from 6 to 10 carbon atoms;

$X_2$ represents —O—, —S—, —COO—, $$-\underset{\underset{R_{35}}{|}}{N}CO-,\ -\underset{\underset{R_{35}}{|}}{N}SO_2-,\ -\underset{\underset{R_{35}}{|}}{N}-,$$

—CO—, $-SO_2-$, or $-SO_2O-$;

Z represents a carboxy group, a sulfo group, a hydroxy group or $$-N\begin{matrix}R_{35}\\R_{36}\end{matrix};$$

$R_{35}$ and $R_{36}$, which may be the same or different, each represents a hydrogen atom or a substituted or unsubstituted aliphatic group having from 1 to 3 carbon atoms;

a represents 0 or 1;

b represents an integer of from 1 to 3, and when b is plural, said Zs may be the same or different, and l represents 2 or 3 and said $l(R_3-X_2)$s may be the same or different.

15. The silver halide color photographic material as claimed in claim 1, wherein the compound releasing a bleach accelerator represented by formula (I) is a compound represented by formula (IV):

$$A-(L_1)_a-S-\underbrace{\{R_{31}-(X_2)_m\}-R_{33}}_{(Z)_u} \qquad \text{(IV)}$$

wherein

A represents a coupler residue or an oxidation-reduction group;

$L_1$ represents a timing group;

$R_{31}$ represents a substituted or unsubstituted aliphatic group having from 1 to 6 carbon atoms or a substituted or unsubstituted aromatic group having from 6 to 10 carbon atoms;

$R_{33}$ represents a 3- to 7-membered carbon ring group or a 3- to 7-membered substituted or unsubstituted heterocyclic ring having less than 4 nitrogen atoms as the ring-constituting atoms;

$X_2$ represents —O—, —S—, —COO—, $$-\underset{\underset{R_{35}}{|}}{N}CO-,\ -\underset{\underset{R_{35}}{|}}{N}SO_2-,\ -\underset{\underset{R_{35}}{|}}{N}-,$$

—CO—, —$SO_2$—, or —$SO_2O$—;

Z represents a carboxy group, a sulfo group, a hydroxy group or

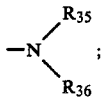

$R_{35}$ and $R_{36}$, which may be the same or different, each represents a hydrogen atom or a substituted or unsubstituted aliphatic group having from 1 to 3 carbon atoms;

a represents 0 to 1;

m represents 0 or 1;

r represents an integer of from 0 to 3, and when r is plural, said plural $\{R_{31}—(X_2)_m\}$s may be the same or different; and u represents a integer of from 0 to 3; when $R_{33}$ is a carbon ring said u is, however, 1 to 3, and when u is plural said Zs of $(Z)_u$ may be the same or different.

16. The silver halide color photographic material as claimed in claim 1, wherein the compound releasing a bleach accelerator represented by formula (I) is a compound represents by formula (V):

$$A—(L_1)_a—S—R_{31}—(Z)_t \qquad (V)$$

wherein

A represents a coupler residue or an oxidation-reduction group;

$L_1$ represents a timing group;

$R_{31}$ represents a substituted or unsubstituted aliphatic group having from 1 to 6 carbon atoms or a substituted or unsubstituted aromatic group having from 6 to 10 carbon atoms;

Z represents a carboxy group, a sulfo group, a hydroxy group or

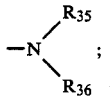

$R_{35}$ and $R_{36}$, which may be the same or different, each represents a hydrogen atom or a substituted or unsubstituted aliphatic group having from 1 to 3 carbon atoms;

a represents 0 or 1, and t represents 2 or 3 and said plural Zs of (Z)t may the same or different.

17. The silver halide color photographic material as claimed in claim 1, wherein the compound releasing a bleach accelerator represented by formula (I) is a compound represented by formula (VI):

$$A—L_2—S—\underbrace{\{R_{31}—(X_2)_m\}_r}_{(Z)_b}—R_{34} \qquad (VI)$$

wherein

A represents a coupler residue or an oxidation-reduction group;

$L_2$ represents a group becoming a coupler residue after cleaving from a or a group becoming an oxidation-reduction group after cleaving from A;

$R_{31}$ represents a substituted or unsubstituted aliphatic group having from 1 to 6 carbon atoms or a substituted or unsubstituted aromatic group having from 6 to 10 carbon atoms;

$R_{34}$ is the same as defined above for $R_{31}$ or represents a 3- to 7-membered substituted or unsubstituted heterocyclic group;

$X_2$ represents —O—, —S—, —COO—,

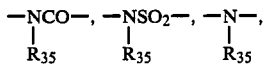

—CO—, —$SO_2$—, or —$SO_2O$—;

Z represents a carboxy group, a sulfo group, a hydroxy group or

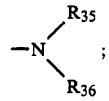

$R_{35}$ and $R_{36}$, which may be the same or different, each represents a hydrogen atom or a substituted or unsubstituted aliphatic group having from 1 to 3 carbon atoms;

b represents an integer of from 1 to 3, and when b is plural, said Zs may be the same or different;

m represents 0 or 1; and r represents an integer of from 0 to 3, and when r is plural, said plural $\{R_{31}—(X_2)_m\}$s may be the same or different.

* * * * *